US006998029B2

(12) United States Patent
Hardee et al.

(10) Patent No.: US 6,998,029 B2
(45) Date of Patent: Feb. 14, 2006

(54) ANODIC PROTECTION SYSTEMS AND METHODS

(75) Inventors: Kenneth L. Hardee, Middlefield, OH (US); Michael S. Moats, Mentor on the Lake, OH (US); Carl W. Brown, Jr., Leroy Township, OH (US); Robert L. Wilhelm, Geneva, OH (US); Edward M. Halko, Mentor, OH (US); Zane A. Wade, Montville, OH (US)

(73) Assignee: Eltech Systems Corporation, Chardon, OH (US)

( * ) Notice: Subject to any disclaimer, the term of this patent is extended or adjusted under 35 U.S.C. 154(b) by 456 days.

(21) Appl. No.: 10/218,368

(22) Filed: Aug. 14, 2002

(65) Prior Publication Data

US 2003/0066759 A1 Apr. 10, 2003

Related U.S. Application Data

(60) Provisional application No. 60/402,722, filed on Aug. 12, 2002, provisional application No. 60/312,472, filed on Aug. 15, 2001.

(51) Int. Cl.
*C25B 9/04* (2006.01)

(52) U.S. Cl. ..... 204/228.1; 204/229.8; 204/230.2; 204/230.5; 204/267; 204/268; 204/278.5

(58) Field of Classification Search ..... 204/228.1, 204/229.8, 230.2, 230.5, 230.8, 267, 268, 204/278.5
See application file for complete search history.

(56) References Cited

U.S. PATENT DOCUMENTS

| | | | | |
|---|---|---|---|---|
| 5,632,872 | A | 5/1997 | Dattilo | 204/290 R |
| 6,139,705 | A | 10/2000 | Brown, Jr. et al. | 204/284 |
| 6,344,124 | B1 * | 2/2002 | Bhatnagar | 205/96 |
| 6,368,489 | B1 | 4/2002 | Hardee et al. | 205/578 |

* cited by examiner

*Primary Examiner*—Bruce F. Bell
(74) *Attorney, Agent, or Firm*—Renner, Otto, Boisselle & Sklar, LLP

(57) ABSTRACT

Various systems and methods for protecting electrowinning anodes having electrocatalytically active coatings in a bank of electrolytic cells from being damaged by reverse currents. In the first embodiment, one or more auxiliary power sources are provided that, when triggered by one or more predetermined conditions being met, keep the bank of electrolytic cells in an electrical state that is relatively harmless to the anodes having electrocatalytically active coatings. In a second embodiment, the invention is directed to a method of maintaining the polarization of anodes in an electrowinning cell positive of the cathodes (i.e. in a potential region where the anode coating is not susceptible to significant damage). In a final embodiment, the invention is directed to various methods for the installation of replacement anodes and maintenance of electrowinning cells.

29 Claims, 13 Drawing Sheets

ANODIC PROTECTION SYSTEMS AND METHODS

This application claims priority to U.S. Provisional Application Ser. No. 60/312,472, filed Aug. 15, 2001, and entitled ANODIC PROTECTION SYSTEMS AND METHODS, , which is hereby incorporated by reference in its entirety. This application also claims priority to U.S. Provisional Application Ser. No. 60/402,722 filed Aug. 12, 2002, also entitled ANODIC PROTECTION SYSTEMS AND METHODS, listing Messrs. Hardee, Halko, Brown Jr., Moats, Wade, and Wilhelm as inventors, which is hereby incorporated by reference in its entirety.

FIELD OF THE INVENTION

The present invention relates generally to the field of electrowinning, and more specifically to systems and methods for protecting anodes having electrocatalytically active coatings in electrowinning cells from damage caused by reverse currents.

BACKGROUND OF THE INVENTION

Electrowinning is a known electrolytic technology used to recover metals from various aqueous, metal-containing solutions, i.e. electrolytes, e.g., the primary production of metal via leaching of ores or from electroplating rinse waters. A typical electrowinning system typically comprises three primary components: at least one electrolytic cell having a plurality of alternating anodes and cathodes, a source of DC electrical power (typically referred to as a "rectifier"), and a pump that pumps the electrolyte through at least one electrolytic cell between the anodes and cathodes. In a typical large electrowinning facility, tens of thousands of amperes of current at several hundred volts are passed through the electrolyte causing the metal to electrodeposit on the cathodes. Periodically, the cathodes are removed from the electrolyte and the electrodeposited metal is removed ("harvested") and the cathodes replaced into the electrolyte. FIGS. 1A–1C show various aspects of typical electrowinning plates and cells and FIG. 2 shows a typical generic electrowinning system 20.

Referring now to FIGS. 1A–1C, a typical electrowinning cell 10 is shown schematically. The cell 10 comprises a container 11 ("cell") for containing the electrolyte 12 and a plurality of cathodes 14 (shaded in FIGS. 1A–1C) and anodes 15 (unshaded in FIGS. 1A–1C), alternatively spaced as shown, with the electrolyte flowing therebetween. The anodes 15 and cathodes 14 typically comprise a support having a conductor bar 16 (also known as a "lug" or an "ear") that is typically in direct electrical connection with an electrolytic plate 17 (FIG. 1B). FIG. 1C shows schematically a four-cell electrowinning cell-line comprising four electrolytic cells 10*a*–10*d*, electrically interconnected by five copper bus bars 18*a*–18*e*. As known to those skilled in the art, the conductor bars 16 of the cathodes 14 and anodes 15 of adjacent cells are typically in direct electrical connection with each other via the bus bars 18. More specific to the four-cell cell-line in FIG. 1C, the conductor bars 16 of the anodes 15 in the first cell 10*a* are physically touching and thus directly electrically connected to the first bus bar 18*a*. The anodes 15 in the first cell 10*a* are in circuit communication with the cathodes 14 in the first cell 10*a* via the electrolyte (not shown in FIG. 1C). "Circuit communication" as used herein indicates a communicative relationship between devices. Direct electrical, electromagnetic, and optical connections and indirect electrical, electromagnetic, and optical connections are examples of circuit communication. Two devices are in circuit communication if a signal from one is received by the other, regardless of whether the signal is modified by some other device. For example, two devices separated by one or more of the following-amplifiers, filters, transformers, optoisolators, digital or analog buffers, analog integrators, other electronic circuitry, fiber optic transceivers, or even satellites-are in circuit communication if a signal from one is communicated to the other, even though the signal is modified by one or more intermediate devices. As another example, an electromagnetic sensor is in circuit communication with a signal if it receives electromagnetic radiation from the signal. As a final example, two devices not directly connected to each other, but both capable of interfacing with a third device, e.g., a CPU, are in circuit communication. Also, as used herein, voltages and values representing digitized voltages are considered to be equivalent for the purposes of this application, unless otherwise noted, and thus, unless otherwise noted, the term "voltage" as used herein refers to either a signal, or a value in a processor representing a signal, or a value in a processor determined from a value representing a signal. All the conductor bars 16 of the cathodes 14 in the first cell 10*a* are physically touching and thus directly electrically connected to the second bus bar 18*b*. Similarly, all the conductor bars 16 of the anodes 15 in the second cell 10*b* are physically touching and thus directly electrically connected to the second bus bar 18*b*. Thus, all the cathodes 14 in the first cell 10*a* are electrically connected to all the anodes 15 in the second cell 10*b* via the second bus bar 18*b*. This structure repeats for the second cell 10*b*, the third cell 10*c*, and the fourth cell 10*d*, ending with all the conductor bars 16 of the cathodes 14 in the fourth cell 10*d* physically touching and thus directly electrically connected to the fifth bus bar 18*e*.

FIG. 2 shows an electrowinning ("EW") direct current ("DC") power supply 22 in circuit communication with a bank of electrolytic cells 24. The bank of electrolytic cells 24 in FIG. 2 comprises a plurality of electrolytic cells 26*a*–26*n*. The bank 24 is shown in FIG. 2 as comprising one string of electrolytic cells 26*a*–26*n* all connected in series (known as a "cell-line"). Although the bank 24 is shown as a single cell-line, the embodiments of the present invention are believed to apply to virtually any configuration of any number of electrolytic cells connected in virtually any configuration, e.g., numerous cell-lines in series and/or parallel. The electrolytic cells are typically of the type as shown in FIGS. 1A–1C having a plurality of anode plates spaced from a plurality of cathode plates, with the EW electrolyte in the spaces therebetween. The EW DC power supply 22, also referred to as an EW rectifier, generates a very high-current signal at a voltage output 30 relative to a ground 32 that is typically electrically connected to the ends of the bank 24 of cells 26. If the four-cell cell-line of FIG. 1C were used as the bank 24, the output 30 would be electrically connected to the first bus bar 18*a* and the ground 32 would be electrically connected to the last bus bar 18*e*. In a typical large EW application having multitudes of cells 26, the output of the EW DC power supply 22 can be hundreds of volts having a very high current on the order of 5000 amperes to 50,000 amperes or more. As known to those skilled in the art, the current, indicated as leaving the EW DC power supply 22 at 34 and returning to the EW DC power supply 22 at 35, passes through a circuit comprising voltage output 30, the bank of electrolytic cells 24, ground 32, and back to the EW DC power supply 22. As discussed above, inside each electrolytic cell 26, the current 34, 35 passes from a bus bar 18 to the anodes 15 (FIGS. 1A and 1C), through the electrolyte 12 from which metals are being deposited (FIG. 1A), to the cathodes 14, to the next bus bar 18 (FIG. 1C).

As known to those in the art, the plates 17 of the cathodes 14 and anodes 15 can be made of different materials, depending on various factors, such as the electrolyte and the electrodeposited metal. For example, lead alloy (e.g. Pb—Ca—Sn) anodes are typically used to electrowin copper from various copper-containing solutions. If particular materials, e.g., lead, are selected for the anode plates, a reverse current will be developed if the EW DC power supply 22 ceases providing sufficient voltage and current to maintain a forward current in the cells 26. This reverse current is the result of the electrochemical reduction of the lead oxide surface deposit formed on the lead anode in normal operation and the oxidation of the product metal, e.g. copper. In ordinary EW installations, the reverse currents are not harmful, although they do decrease the net efficiency for the production of metal and increase the contamination of the electrolyte by loosening the surface deposits on the lead anode, and are generally ignored. Recently, however, various electrocatalytically active coatings have been used on electrowinning anodes, e.g., the technology disclosed in U.S. Ser. No. 09/648,506 and U.S. Pat. No 6,139,705 to the assignee of the present invention, which is marketed and sold in the industry as the Mesh-on-Lead (MOL™) technology. These electrocatalytically active coatings are sensitive to reverse currents and include such coatings as platinum or other platinum group metals or they can be represented by active oxide coatings such as platinum group metal oxides, magnetite, ferrite, cobalt spinel or mixed metal oxide coatings. The mixed metal oxide coatings can often include at least one oxide of a valve metal with an oxide of a platinum group metal including platinum, palladium, rhodium, iridium and ruthenium or mixtures of themselves and with other metals. When anode plates using these electrocatalytically active coatings are used in the same EW system with more traditional anode plates that can generate a reverse current, the reverse current can severely and irreversibly damage the electrocatalytically active coatings. For example, when anode plates using platinum group metal oxide containing coatings (especially those with palladium) are placed in series electrical relationship with lead anodes, if the EW DC power supply 22 ceases generating the EW voltage at output 30, a reverse current will be generated of sufficient magnitude to severely and irreversibly damage the electrocatalytically active coating on the anodes.

There is a need, therefore, for various systems and methods for protecting anodes having electrocatalytically active coatings in electrowinning cells from damage caused by reverse currents.

SUMMARY OF THE INVENTION

The present invention is directed toward various systems and methods for protecting anodes having electrocatalytically active coatings from being damaged by reverse currents. There are a number of different embodiments of the present invention disclosed herein for protecting electrowinning anodes having electrocatalytically active coatings from the reverse currents discussed in the Background. Different variations of many embodiments are presented herein. In the first embodiment, a high-current switch is used to electrically break the flow of current through the bank of electrolytic cells 24 if one or more predetermined conditions are met, thus protecting the anodes by preventing a reverse current from generating. In a second embodiment, one or more auxiliary power sources are provided that, when triggered by one or more predetermined conditions being met, keep the bank of electrolytic cells 24 in an electrical state that is relatively harmless to the anodes having electrocatalytically active coatings. In a third embodiment, physical lifting mechanisms are used to automatically lift cathodes and/or anodes to physically break the flow of current through the electrolytic cell 24 if one or more predetermined conditions are met, thus preventing a reverse current from generating and thereby protecting the anodes having electrocatalytically active coatings. In a fourth embodiment, the electrocatalytically active anodes are maintained at a potential sufficiently positive, with respect to the potential at which damage to the coating occurs, by means of the addition or maintenance of an oxidizing agent in the electrolyte at a sufficient concentration to support the reverse current and which oxidizing agent is preferentially reduced compared to the electrochemical reduction of components of the coating, thus preventing the potential from shifting more negatively. In a fifth embodiment, various methods for anode insertion and cell maintenance are employed to insure that a reverse current does not flow through MOL anodes in a mixed electrowinning circuit, that is an electrowinning circuit with cells containing MOL anodes or lead sheet anodes.

The various embodiments of the present invention are directed primarily towards the protection of platinum group metal oxide containing coatings (especially those with palladium), however, the various protection systems and methods also have application to numerous other coatings sensitive to electrochemical reduction by reverse currents, e.g., coatings of $MnO_2$ or $Co_3O_4$ or other electrochemically active oxide coatings containing one or more of the elements Fe, Mn, Co, Ni, Cr, Re, W, Cu, Zn, Pb, Bi, Sn, Sb or Lanthanides or composite anode structures, such as those described in U. S. Pat. No. 5,632,872.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to example the principles of this invention, wherein.

DETAILED DESCRIPTION OF THE INVENTION

Figure 3:
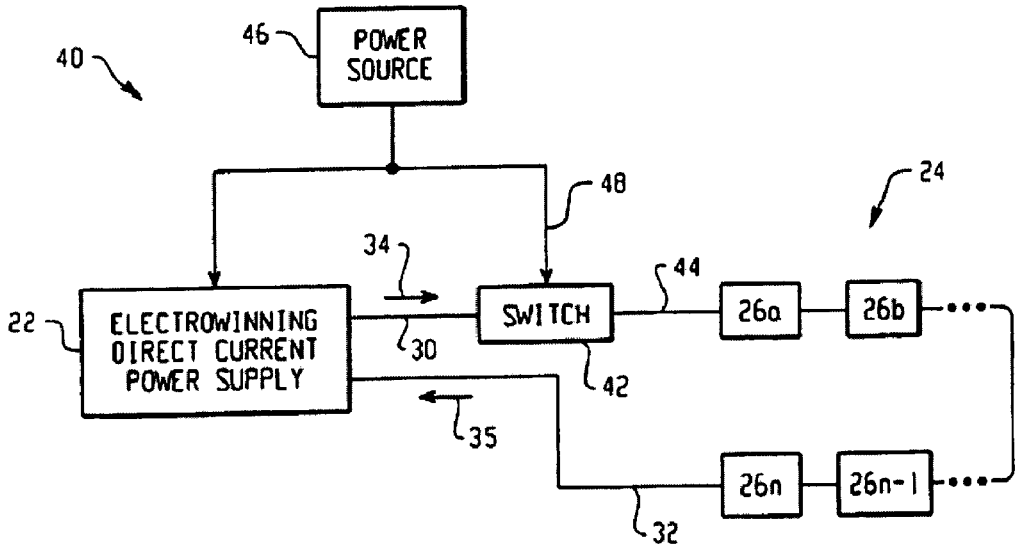
FIG. 3 is a high-level schematic block diagram of an electrowinning system according to a first variation of a first embodiment of the present invention.
Figure 4:
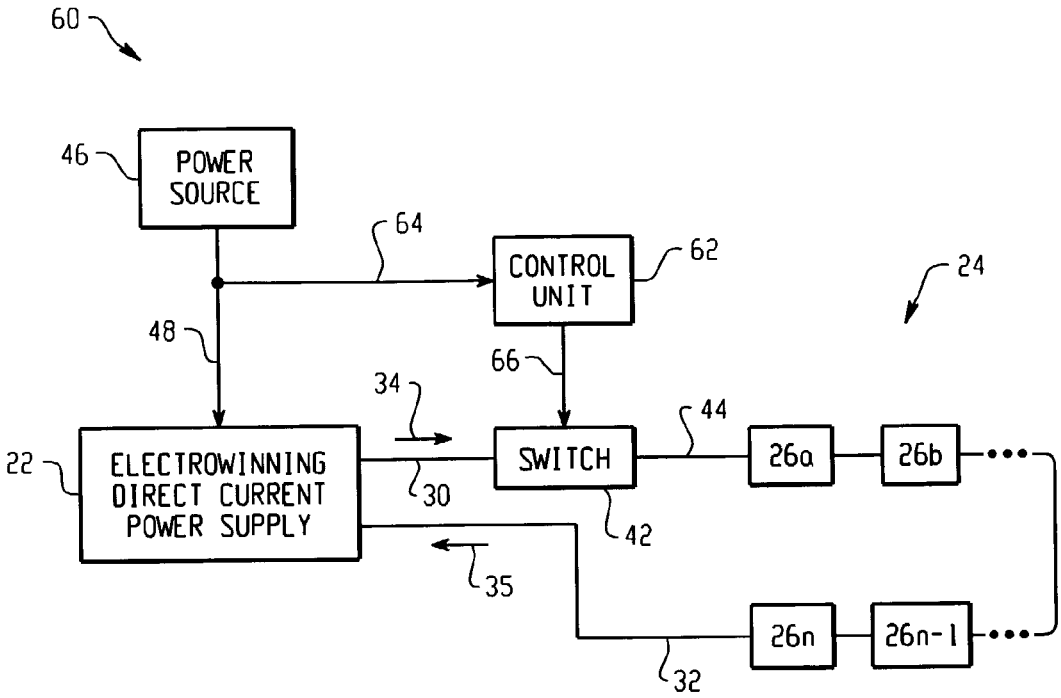
FIG. 4 is a high-level schematic block diagram of an electrowinning system according to a second variation of the first embodiment of the present invention.
Figure 5:
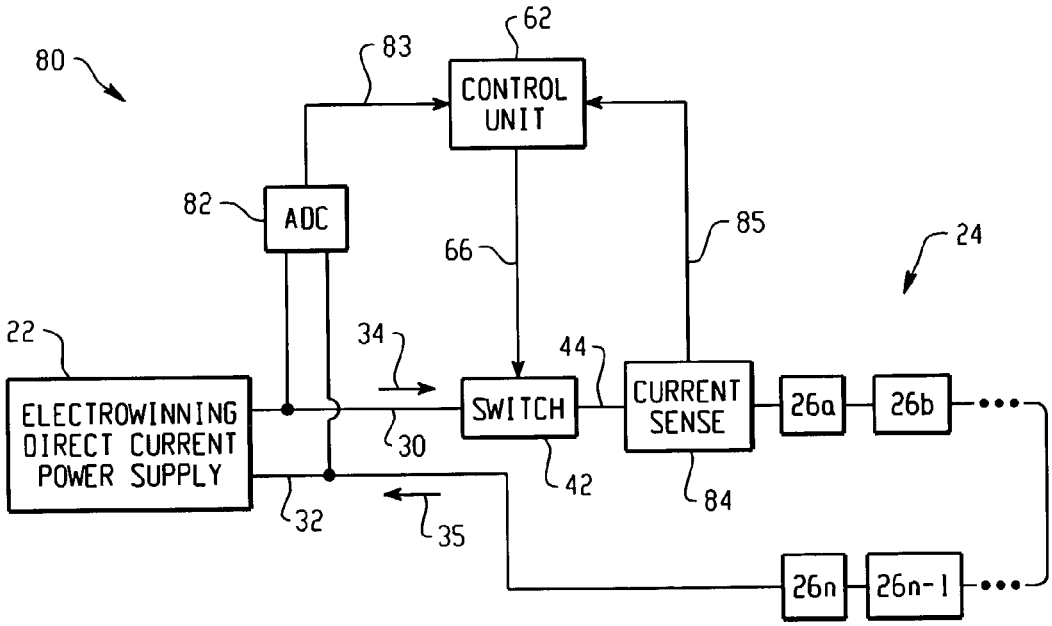
FIG. 5 is a high-level schematic block diagram of an electrowinning system according to a third variation of the first embodiment of the present invention.

There are a number of different embodiments of the present invention disclosed herein for protecting electrowinning anodes from the reverse currents discussed in the Background. In the first embodiment, variations of which are shown in FIGS. 3–5, a high-current switch is used to electrically break the flow of current through the bank of electrolytic cells 24 if one or more predetermined conditions are met, thus protecting the anodes.

Figure 6:
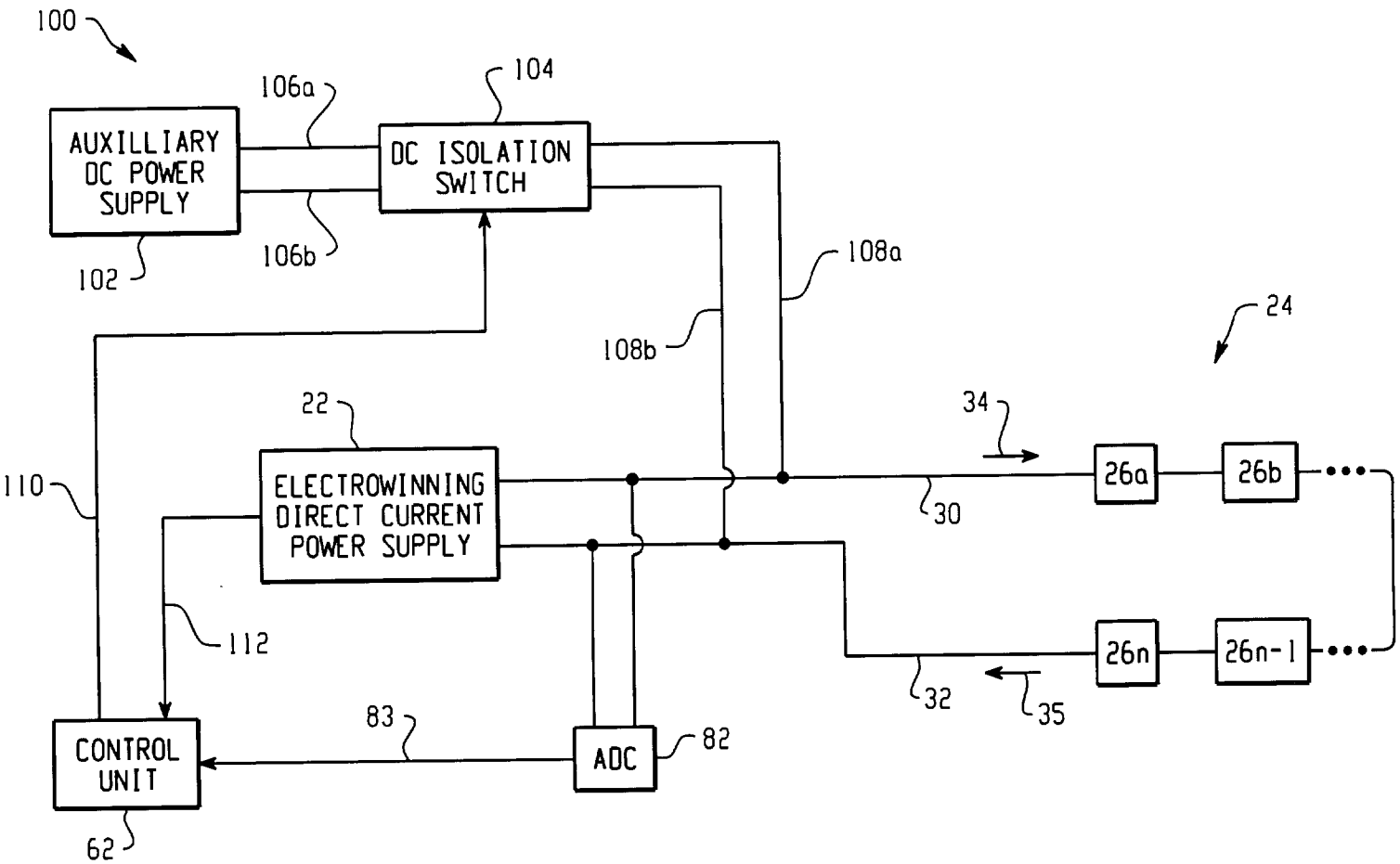
FIG. 6 is a high-level schematic block diagram of an electrowinning system according to a second embodiment of the present invention.
Figure 7:
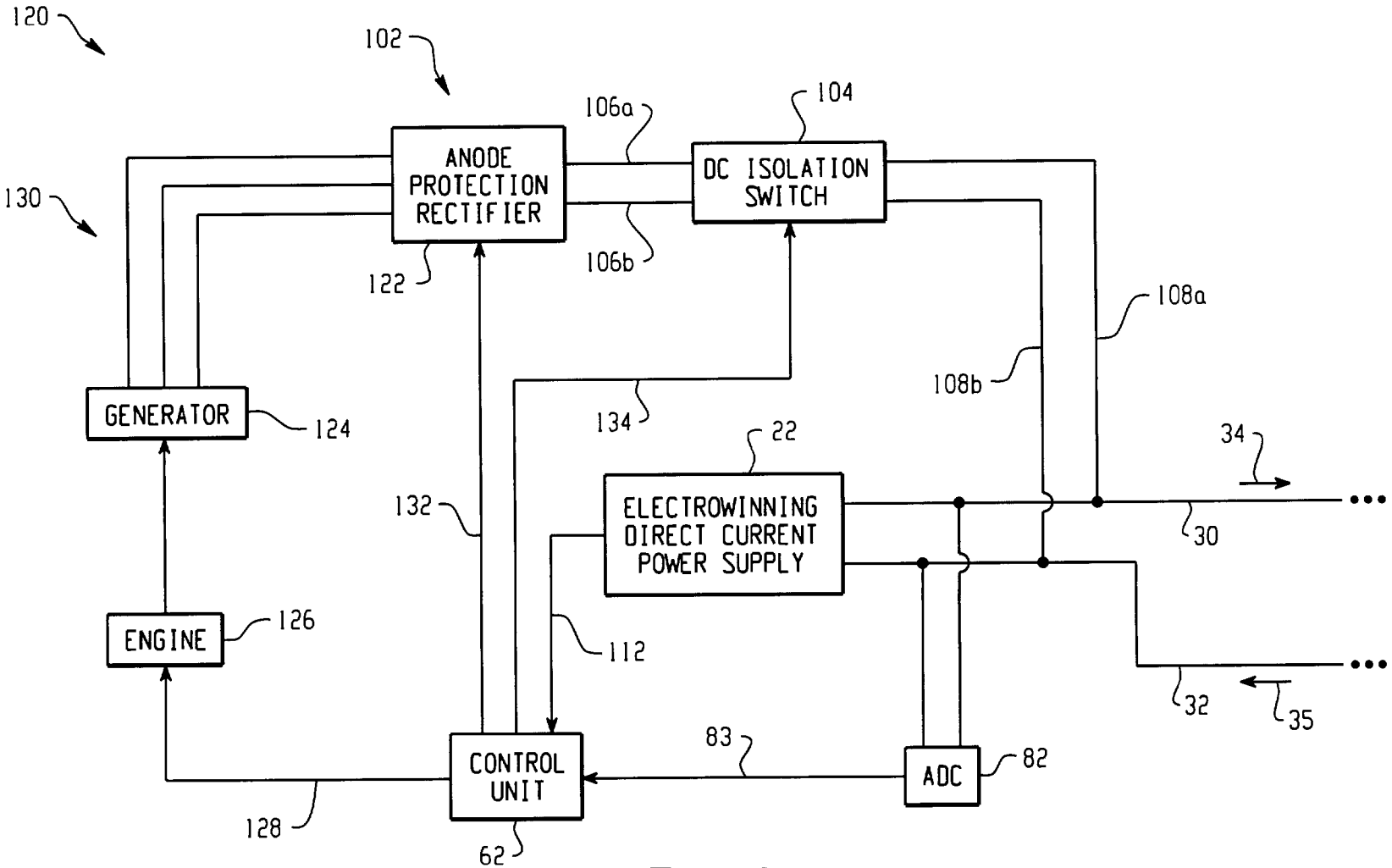
FIG. 7 is a high-level schematic block diagram of an electrowinning system according to the second embodiment of the present invention having a single auxiliary DC power supply.
Figure 8:
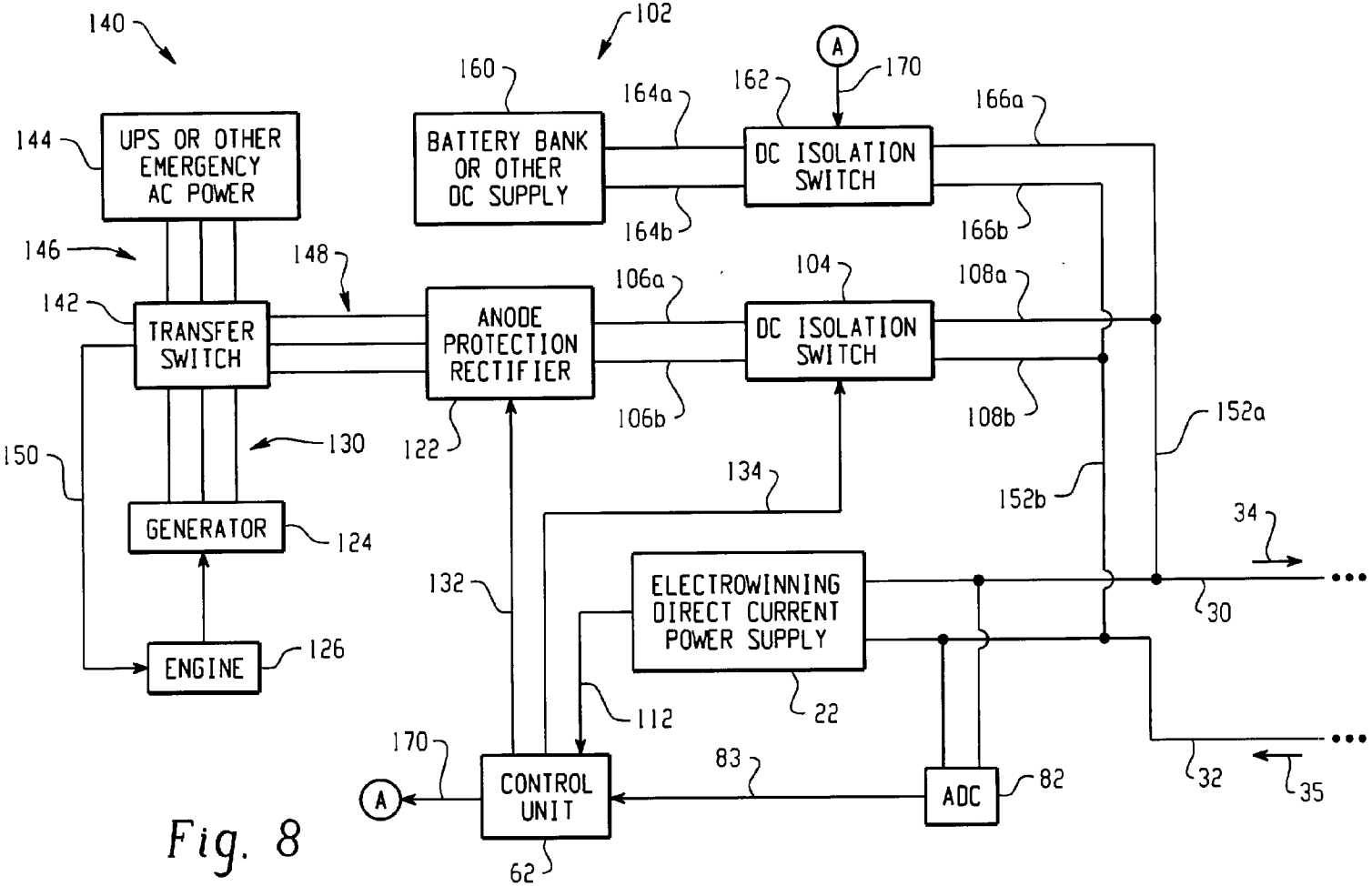
FIG. 8 is a high-level schematic block diagram of an electrowinning system according to the second embodiment of the present invention having a plurality of auxiliary DC power supplies.

In a second embodiment, variations of which are shown in FIGS. 6–8, one or more auxiliary power sources are provided that, when triggered by one or more predetermined conditions being met, keep the bank of electrolytic cells 24 in an electrical state that is relatively harmless to the anodes.

In a third embodiment, physical lifting mechanisms are used to automatically lift cathodes and/or anodes to physically break the flow of current through the electrolytic cell 24 if one or more predetermined conditions are met, thus protecting the anodes.

In a fourth embodiment, the invention is directed to a method of maintaining the polarization of anodes in an electrowinning cell positive of the cathodes (i.e. in a potential region where the anode coating is not susceptible to significant damage), the method comprising the steps of providing an unseparated electrolytic cell, establishing in the cell an electrolyte containing a metal for electrowinning, providing an anode in the cell in contact with the electrolyte, including in the electrolyte a soluble species, the soluble species comprising a reducible species and a corresponding oxidizable product, the soluble species having a potential greater than the potential of the metal in the electrolyte, whereby the soluble species is reduced at the anode during a reverse current flow such that the electrode potential of the anode is maintained at the potential of the soluble species on application of a reverse current to the electrowinning cell. Note that the anode, here, refers to the electrode at which the oxidation reaction (i.e. oxygen evolution) occurs during normal, forward current operation of the electrowinning cell, recognizing that it effectively becomes a "cathode" during a reverse current flow.

In a final embodiment, the invention is directed to various methods for the installation of MOL anodes and maintenance of electrowinning cells.

Recall that many electrolytic cells in an electrowinning tankhouse are typically connected in series. Since the principal reverse current flows through the inter-cell connections (i.e. bus), breaking the electrical current pathway at any point will prevent the reverse flow of current through all the electrolytic cells. In the first embodiment, a high-current switch is used to electrically break the flow of current through the bank 24 of electrolytic cells 26 if one or more predetermined conditions are met, thus protecting the anodes.

Referring now to FIG. 3, a first variation of the first embodiment is shown. In the electrowinning system 40 shown in FIG. 3, a high-current switch 42 is in circuit communication between the EW DC supply 22 and the electrolytic cell 24, breaking the flow of current 34, 35 through the electrolytic cells 26, preferably near the EW DC power supply 22 at either the voltage output 30 (as shown in FIG. 3) or at the ground 32 (not shown in FIG. 3). In FIG. 3, the current 34, 35 (with switch 42 closed) passes through a circuit comprising voltage output 30, switch 42, connection 44, electrolytic cells 26*a*–26*n*, ground 32, and back to the EW DC power supply 22. The switch 42 in the FIG. 3 variation is preferably powered by the same power source 46, e.g., a local provider of 240 volt three-phase power, as the EW DC power supply 22 via power source line 48. Additionally, the switch 42 is preferably characterized by being closed (allowing current 34, 35 to flow) while the power supply 46 provides power to the EW DC power supply 22 and the switch 42 via power source line 48 and further characterized by opening (thereby breaking the circuit through which current 34, 35 flows) when the power supply 46 ceases providing power to the EW DC power supply 22 and the switch 42 via power source line 48. Switch 42 preferably comprises one or more normally-open high-current switches, e.g., vacuum switches or mercury switches, that are activated (closed) by power source 46 via power source line 48. Thus, so long as the EW DC power supply 22 is powered via power source 46, and the EW DC power supply 22 is presumably providing sufficient voltage and current to prevent a reverse current from being generated and harming the anodes, switch 42 in FIG. 3 remains closed and current 34, 35 flows through the bank of electrolytic cells 24. However, if the power source 46 ceases providing power to the EW DC power supply 22 and the switch 42 via power source line 48, the switch 42 in FIG. 3 deactivates (i.e., opens or "trips"), opening the current path, shutting off the current 34, 35 through the bank of cells 24, thereby preventing a harmful reverse current from generating and thereby protecting the anodes. As to recovering from the tripped condition, the switch 42 in the circuit of FIG. 3 can be configured, either inherently to switch 42 or by accompanying circuitry (not shown) either to automatically re-close once the power source 46 begins providing power again via line 48 or to require one or more actions before it re-closes, e.g., manually pressing a reset button and/or requiring a specific input from an electronic circuit, e.g., a control unit (all not shown).

Although the variation of FIG. 3 is preferred from a low-cost standpoint, requiring few parts and not requiring any type of control unit, the configuration of switch 42 in FIG. 3 is subject to tripping (breaking the current path) in response to brownouts by power source 46 and/or temporary local power fluctuations at power source line 48. This can be overcome to some extent by configuring the switch 42 in FIG. 3, either inherently to switch 42 or by accompanying circuitry (not shown) to require that a predetermined period of time pass after detecting that the power source 46 has ceased providing power via line 48 before tripping.

FIG. 4 shows a second variation of the first embodiment that can also provide resistance to false tripping in response to brownouts by power source 46 and/or temporary local power fluctuations at power source line 48. The EW system 60 shown in FIG. 4 is similar in many respects to the variation shown in FIG. 3, having the high-current switch 42 in circuit communication between the EW DC supply 22 and the electrolytic cell 24, breaking the flow of current preferably near the EW DC power supply 22 at either the voltage output 30 (as shown in FIG. 4) or at the ground 32 (not shown in FIG. 4). As with FIG. 3, the current 34, 35 in FIG. 4 with switch 42 closed passes through a circuit comprising voltage output 30, switch 42, connection 44, electrolytic cells 26, ground 32, and back to the EW DC power supply 22. The switch 42 in the FIG. 4 variation is preferably controlled by a control unit 62 that is in circuit communication with power source 46 and that monitors the power source line 48 in some fashion, e.g., via line 64. In the variation 60 shown in FIG. 4, control unit 62 preferably controls the opening and closing of switch 42 via a control line 66 (via a driver circuit, not shown, if necessary, as known to those skilled in the art) having at least two states, a first state that causes switch 42 to close (allowing current to flow) and a second state that causes switch 42 to open (blocking the flow of current through the bank 24 electrolytic cells 26). Control unit 62 preferably has its own power supply (not shown) independent of power source 46, so that it can control switch 42 whether the power source 46 is providing power or not. As with the variation of the first embodiment shown in FIG. 3, the switch 42 in FIG. 4 is preferably characterized as a normally open switch, so that if power source 46 completely ceases providing power and the independent power supply of control unit 62 ceases providing power, the switch 42 will open, breaking the circuit between the EW DC power supply 22 and the bank of electrolytic cells 24, thereby preventing a harmful reverse current from generating.

The control unit 62 in the various embodiments and variations shown and/or described herein may be virtually any control unit, e.g., state machines implemented using, e.g., flip flops, a preprogrammed processor, etc. As to a preprogrammed processor implementing the control unit 62, it may be one of virtually any number of processor systems and/or stand-alone processors, such as microprocessors, microcontrollers, and digital signal processors, and has associated therewith, either internally therein or externally in circuit communication therewith, associated RAM, ROM, EPROM, clocks, decoders, memory controllers, and/or interrupt controllers, etc. (all not shown) known to those in the art to be needed to implement a processor circuit. The preferred control unit 62 is a preprogrammed programmable logic controller ("PLC").

Control unit 62 is preferably in circuit communication with power source 46 to monitor the power source line 48 in some fashion, e.g., via line 64. Any one or more of several parameters of the power signals provided on power line 48 can be monitored by the control unit 62, e.g., voltage, current, phase, etc. Monitoring one or more of these parameters can allow the control unit 62 to be configured and/or programmed to discriminate between, for example, a power failure at power source 46 (which would clearly prevent the EW DC power supply 22 from generating sufficient voltage and current at voltage output 30 to prevent a reverse current from damaging the anodes) and merely a non-threatening brownout (one that would not affect the EW DC power supply's ability to prevent a reverse current from damaging the anodes) by power source 46. Additionally, the control unit 62 can be configured and/or programmed to require that a predetermined period of time pass after detecting that one or more parameters of the signal provided by the power source 46 have crossed respective thresholds, indicating that the EW DC power supply 22 may be affected, before tripping (opening) switch 42. The control unit 62 in the circuit of FIG. 4 can be configured and/or preprogrammed to automatically re-close switch 42 once the monitored parameters of power source 46 are restored above respective thresholds or to require action before it re-closes switch 42, e.g., manually pressing a reset button (not shown) in circuit communication with control unit 62 and/or in circuit communication with switch 42.

Although the variations of the first embodiment shown in FIGS. 3 and 4 have a benefit in that they are relatively simple circuits having relatively low parts counts, they rely on the assumption that if the power source 46 is providing power to the EW DC power supply 22, then no reverse current is being generated. Other variations add additional circuitry that allows the switch 42 and/or the control unit 62 to monitor the voltage and/or current 34, 35 of the EW DC signal 30 generated by the EW DC power supply 22. With this additional circuitry, if the power source 46 is providing appropriate power via line 48, but for some reason the EW DC power supply 22 is not providing a signal 30 of sufficient voltage and/or current to the bank of electrolytic cells 24, the switch 42 will be opened, preventing a harmful reverse current from generating. For example, in either FIG. 3 or FIG. 4, a comparator (not shown) (e.g., a comparator implemented with one or more operational amplifiers, not shown) can be placed in circuit communication with output 30 and ground 32 and used to determine if the voltage of signal 30 falls below a predetermined threshold, e.g., the voltage of output 30 falls below 1.4 volts per series-connected electrolytic cell 26 in cell bank 24. Such a comparator could be placed in circuit communication with switch 42 and/or preprogrammed control unit 62 so that the switch 42 is opened whenever the voltage of output 30 falls below the predetermined threshold.

The variation of the first embodiment shown in FIG. 5 adds additional circuitry to allow the control unit 62 to monitor the voltage and/or the current 34, 35 of output 30 generated by EW DC power supply 22 so that if the voltage and/or the current 34, 35 of output 30 generated by EW DC power supply 22 falls below a predetermined threshold, the control unit 62 will open the switch 42, preventing a harmful reverse current from generating in the cells 26. The EW system 80 shown in FIG. 5 is similar in many respects to the variation shown in FIG. 4, having the high-current switch 42 in circuit communication between the EW DC supply 22 and the electrolytic cell 24, breaking the flow of current preferably near the EW DC power supply 22 at either the voltage output 30 (as shown in FIG. 5) or at the ground 32 (not shown in FIG. 5). As with FIGS. 3 and 4, the current 34, 35 in FIG. 5 with switch 42 closed passes through a circuit comprising voltage output 30, switch 42, connection 44, bank 24 of electrolytic cells 26, ground 32, and back to the EW DC power supply 22. As with FIG. 4, the processor 62 in FIG. 5 can be virtually any type of control unit, as discussed above. Control unit 62 preferably controls the opening and closing of switch 42 via control line 66 (via a driver circuit, not shown, if necessary, as known to those skilled in the art) having at least two states, a first state that causes switch 42 to close (allowing current to flow) and a second state that causes switch 42 to open (blocking the flow of current through the electrolytic cells 24).

The EW system 80 shown in FIG. 5 also comprises an analog-to-digital converter ("ADC") 82 in circuit communication to measure the voltage of the EW DC supply 22 and/or current sensor 84 in circuit communication to measure the current 34, 35. The ADC 82 is preferably in circuit communication with output 30 and ground 32 and in circuit communication with control unit 62 via ADC connection 83. The current sensor 84 is preferably in circuit communication with either output 30 (not shown) or switched output 44 (shown) and in circuit communication with control unit 62 via current sense connection 85. The ADC 82 via ADC connection 83 allows the control unit 62 to determine if the voltage of output 30 falls below a predetermined threshold, e.g., the voltage of output 30 falls below 1.4 volts per series-connected electrolytic cell 26 in cell bank 24. The control unit 62 is preferably pre-programmed to open switch 42 whenever the voltage of output 30 falls below the predetermined threshold. The current sensor 84 via current sense connection 85 allows the control unit 62 to determine if the current 34, 35 falls below a predetermined threshold, e.g., the current 34, 35 falls to about zero amperes. The control unit 62 is preferably pre-programmed to open switch 42 whenever the current 34, 35 falls below the predetermined threshold. As should be apparent from the discussions above, when the switch 42 is opened, a harmful reverse current cannot generate, which acts to protect the anodes.

Although the switch 42 is shown in FIGS. 3–5 as being positioned between the voltage output 30 and the bank of electrolytic cells 24, the switch 42 can be positioned virtually anywhere in the circuit including the EW DC power supply 22 and the bank 24, by way of example, but not of limitation, between any of the cells 26 in bank 24. As should be apparent from the discussions herein, if there a number of cell-lines connected in parallel inside cell bank 24, and if the switch 42 is positioned within the bank 24, there must be one such switch for each cell-line connected in parallel inside cell bank 24.

In many of the variations of the first embodiment described herein, the switch 42 is powered by the power source 46 and/or controlled by the control unit 62. In the alternative, the switch 42 in the many variations can be powered by the EW voltage at output 30 into the closed position (e.g., by tapping the EW DC bus) so that when the EW DC signal at output 30 fails, the switch 42 opens, preventing a reverse current from generating.

In the second embodiment, one or more auxiliary power sources are provided that, when triggered by one or more predetermined conditions being met, keep the bank of electrolytic cells 24 in an electrical state that is relatively harmless to the anodes, thus protecting the anodes. Preferably, the auxiliary power source is sized to maintain a forward (anodic) current through the bank 24 of electrolytic cells 26 (i.e., maintains the polarization of the anodes in the EW cells 26 positive with respect to the cathodes) and is activated and/or placed in circuit communication with the bank 24 of electrolytic cells 26 when one or more predetermined conditions are met (e.g., one of the monitored parameters of the EW DC supply, e.g., voltage and/or current, reaches a predetermined threshold).

FIG. 6 shows a high-level implementation of the second embodiment of the present invention. The EW system 100 of FIG. 6 comprises an EW DC power supply 22 in circuit communication with a bank 24 of electrolytic cells 26 as discussed above. The EW system 100 of FIG. 6 also comprises a control unit 62 as discussed above in circuit communication with an ADC 82 monitoring the output 30, as discussed above. The control unit 62 also preferably monitors the current 34, 35, shown schematically by line 112 from the EW DC power supply 22 to the control unit 62, e.g., by using a current sense (not shown) in circuit communication with the EW DC power supply 22, like current sense 84 in FIG. 5. The EW system 100 of FIG. 6 also comprises an auxiliary DC power supply 102 that is preferably placed in circuit communication with the bank 24 of cells 26 via a DC isolation switch 104. Preferably, the auxiliary DC power supply 102 is sized to maintain a forward (anodic) current through the bank 24 of electrolytic cells 26 when the EW DC power supply 22 ceases providing sufficient power to do so, i.e., maintains the polarization of the anodes in the EW cells 26 positive with respect to the cathodes. The auxiliary DC power supply 102 preferably generates an output 106*a*, 106*b* that is selectively switched by DC isolation switch 104 to switched auxiliary output 108*a*, 108*b*, which is in circuit communication with the bank 24 of electrolytic cells 26. On the one hand, when DC isolation switch 104 is open, the auxiliary DC power supply 102 is not in circuit communication with the bank 24 of electrolytic cells 26. On the other hand, when DC isolation switch 104 is closed, the auxiliary DC power supply 102 is not in circuit communication with the bank 24 of electrolytic cells 26. The control unit 62 is preferably preprogrammed to close DC isolation switch 104 when the voltage of output 30 falls below a predetermined threshold, e.g., the voltage of output 30 falls below 1.4 volts per series-connected electrolytic cell 26 in cell bank 24, or the current 34, 35 falls to below a predetermined threshold, e.g., the current 34, 35 falls to about zero amperes. The DC isolation switch 104 can be a normally-closed DC switch, e.g., a mechanical relay, and is preferably connected in circuit communication so that if power to the EW DC power supply 22 and/or the control unit 62 is lost, then the auxiliary DC power supply 102 will activate (if necessary), and the DC isolation switch 104 will close, placing the auxiliary DC power supply in circuit communication with the bank 24 of electrolytic cells 26.

An auxiliary DC power supply 102 that provides a suitable voltage, e.g., preferably at least 1.4 volts per series-connected electrolytic cell 26 in cell bank 24, at a much lower forward current than is necessary for electrowinning, e.g., preferably on the order of at least one milliamp per square meter of anode plate area to one ampere per square meter of anode area, will be sufficient to maintain the potential of the anodes above a safe limit and thus will be sufficient to prevent a reverse current from generating. The voltage of the auxiliary DC power supply 102 is more preferably at least 1.5 volts per series-connected electrolytic cell 26 in cell bank 24. The voltage of the auxiliary DC power supply 102 is most preferably at least 1.5 volts per series-connected electrolytic cell 26 in cell bank 24, plus an appropriate number of volts (e.g., 5 volts) to compensate for voltage losses in the EW system resulting from high currents passing through inherent resistances of the various connections in the system. The current provided by the auxiliary DC power supply 102 to the bank 24 of electrolytic cells 26 is more preferably between 2–4 amperes per square meter of anode plate area. A current from the auxiliary DC power supply 102 of about 1% to 2% of the normal EW current should be adequate to ensure a voltage of 1.4 volts per cell. Thus, a typical 58-cell EW cell-line would be protected from reverse currents by an auxiliary DC power supply 102 having a nominal output of 100 volts DC at 250–500 amperes (~2–4 $A/m^2$), which is much less than the typical EW current of between 5000 amperes and 50,000 amperes for a typical 58-cell EW cell-line. As should be apparent from the discussions herein, each additional 58-cell cell-line added in parallel to the bank 24 would require an additional 250–500 amperes (~2–4 A/m$^2$) of current from the auxiliary DC power supply 102. Each additional electrolytic cell 26 added would require an additional 1.4 or 1.5 volts from the auxiliary DC power supply 102.

The auxiliary DC power supply 102 can be a bank of standard lead-acid batteries (not shown in FIG. 6). Using a bank of batteries provides both a power source and DC current in one unit, i.e., does not require the use of a rectifier, which is required by some of the auxiliary DC power supplies discussed herein, e.g., as shown in FIG. 7. Voltage and current requirements for implementing an auxiliary DC power supply with a battery bank are the same as discussed above. A bank of eight standard 12-volt lead batteries connected in a series would be sufficient to supply the voltage for a 58-cell cell-line. Using standard deep cycle lead-acid batteries that have a capacity of about 800 ampere-hours, a fully charged battery bank should last about 4 hours. Additional batteries added to the battery bank in parallel will increase the ampere-hour capacity of the battery bank; adding additional batteries to the battery bank in series will increase the voltage. While the anodic protection time of a battery bank-based auxiliary DC power supply 102 may be shorter than that of other systems, e.g., a generator system, a battery bank-based auxiliary DC power supply 102 can easily be sized to provide sufficient time to either restore the main power, manually break the electrical circuit through which the reverse current would flow (e.g. lift a set of anodes), or activate a standby generator. The battery bank-based system would preferably comprise a charging unit to maintain charge on the batteries. This charging system could be powered by the standby generator to maintain the charge on the battery and thus extend the battery lifetime. The battery bank is less complicated than a generator/rectifier system and may be more reliable because it has no moving parts. The control circuit 62 could continually monitor the charge state of the battery bank and alert personnel, e.g., via a lamp and/or an LED and/or or an e-mail message and/or an audible alarm, as to the status of the battery bank and when maintenance/replacement is required. Two independent battery banks could be employed in parallel (e.g., with each preferably having its own DC isolation switch in circuit communication with each other and/or with the control unit 62 so that at least one will be activated if any of the various monitored thresholds are crossed) to provide redundancy. The above discussion of the battery bank also applies to the battery bank used in FIG. 8, which includes a battery bank and other sources as a plurality of auxiliary power supplies.

FIG. 7 shows a version of the FIG. 6 second embodiment of the present invention in which the auxiliary DC power supply 102 is implemented with an anode protection rectifier 122 powered by a generator 124 driven by an engine 126 having an independent fuel supply and capable of being controlled (e.g., activated) by control unit 62. The anode protection rectifier 122 can be a standard EW rectifier with a typical output rating of 250–500 amperes at 100–200 volts, which automatically provides outputs at 106*a* and 106*b* when sufficient power is being provided by generator 124 via lower lines 130. The generator 124 can be a standard electrical generator driven by e.g., a diesel engine 126. The generator 124 is sized to provide sufficient power to operate the anode protection rectifier 122. The engine 126 and generator 124 must be capable of starting, coming up to speed, and generating the current(s) and voltage(s) discussed above in connection with FIG. 6 in about 30 to 60 seconds. There is some inherent resistance to cathodic polarization by the capacitance of the platinum group metal oxide anode coatings, which should provide protection to the anodes for the 30 to 60 seconds required for the engine 126 and generator 124 to begin providing suitable power to the anode protection rectifier 122. Once one of the monitored parameters, e.g., voltage of output 30 or current 34, 35, achieves a predetermined threshold, the control unit first starts the engine 126 via control line 128, then activates rectifier 122 (if necessary) and then closes the DC isolation switch 104, which places the anode protection rectifier 122 in circuit communication with the bank 24 of electrolytic cells 26 to prevent a reverse current from generating.

FIG. 8 shows a version of the FIG. 6 second embodiment of the present invention in which the auxiliary DC power supply 102 is implemented with a plurality of power sources. The plurality of sources are interconnected and prioritized so that those auxiliary power supplies having the most limited availability are used only if those having potentially greater availability are unavailable. The EW system 140 in FIG. 8 has an anode protection rectifier 122, generator 124, and engine 126, as discussed in connection with FIG. 7. Additionally, the system 140 of FIG. 8 has a transfer switch 142 that selects one of several possible AC sources, i.e., generator 124 and either a UPS or other emergency AC power 144. The engine 126 can be controlled by the control unit 62 as in the system 120 of FIG. 7. In the alternative, the engine can be controlled by the transfer switch 142. Additionally, the system 140 of FIG. 8 includes a battery bank 160 (or other DC supply), discussed above, preferably having its own DC isolation switch 162, controlled by control unit 62 via control line 170.

The various auxiliary sources (generator 124 and UPS or other emergency AC power 144 and battery bank 160) and the DC isolation switches are in circuit communication with the control unit 62, which prioritizes the sources so that the auxiliary power supplies having the most limited availability are used only if those having potentially greater availability are unavailable. Presumably, the on-site emergency AC power 144 would have a more extensive availability than either the engine/generator 126/124 (which is limited by its fuel tank) or the battery bank 160 (which can be limited to only an hour or so) and the engine/generator 126/124 presumably has a more extensive availability than the battery bank 160. Using this hierarchy of emergency AC power 144, generator 124, and battery bank 160, as an example, once triggered (e.g., output 30 having a voltage of less than 1.4 volts per cell in a cell-line and/or current 34, 35 at or about zero amperes), if the emergency AC power 144 is providing AC power, then the engine 126 will not be started, DC isolation switch 104 will be closed and DC isolation switch 162 will remain open. Using this same hierarchy, once triggered, if the emergency AC power 144 is not providing AC power, then the engine 126 will be started, and after a short period of time to allow the generator outputs to achieve required levels, DC isolation switch 104 will be closed and DC isolation switch 162 will remain open. Again using this same hierarchy, once triggered, if the emergency AC power 144 is not providing AC power and the engine 126 and generator 124 for some reason do not function, DC isolation switch 104 will remain open and DC isolation switch 162 will be closed. The control unit 62 preferably provides feedback to a user about the status of the various supplies, e.g., which one is currently providing power, an estimate of the remaining capacity of each supply, e.g., in hours, etc., by numerous methods, e.g., a textual display on a CRT, LCD display, or other visual display device or e-mails, etc. Additionally, the sources 144, 124, 160 and isolation switches 104, 162 are preferably interconnected with each other and prioritized independently of the control unit 62 so that in the event of a failure of the control unit 62 (or if there is no control unit 62), some form of prioritization and protection will be provided. For example, the sources 144, 124, 160 and switches 142, 104, 162 are preferably characterized and placed in circuit communication so that if there is a complete power outage (e.g., the control unit 62 fails and no emergency power 144 is available and the generator and/or engine fails), then the DC isolation switch 162 will close, placing the battery bank 160 in circuit communication with the bank 24 of cells 26 and the battery bank 160 will provide some indication to users, e.g., via a lamp or LED or e-mail or another visual device, that the battery bank is active and protecting the anodes and to provide the user notice that intervention is needed to prevent harm to the anodes, e.g., by raising a set of anodes.

Figure 1A:
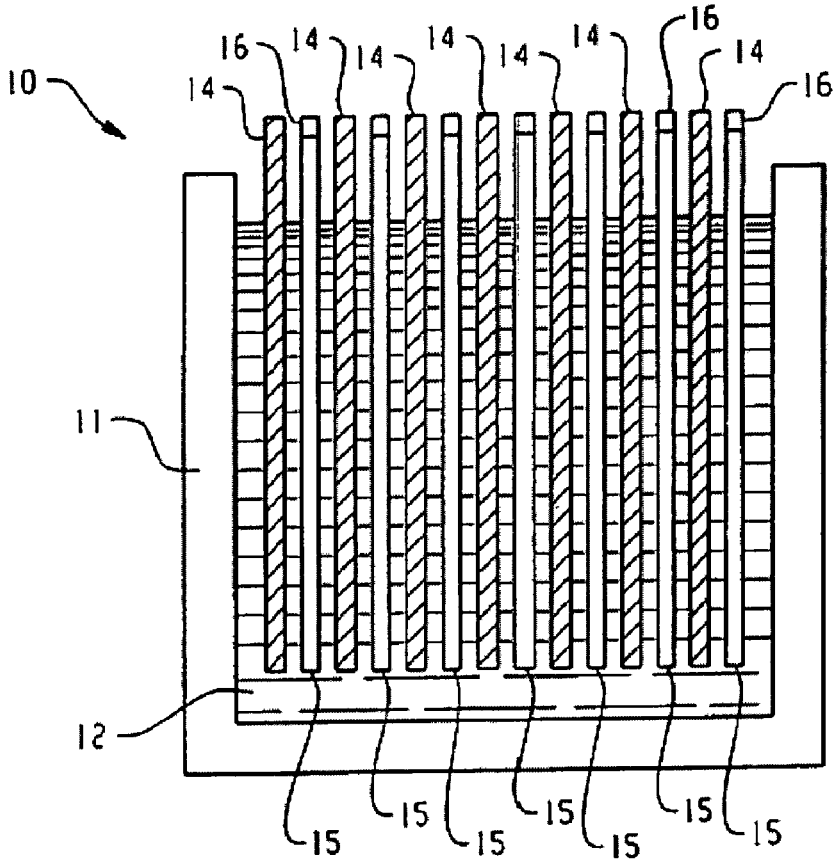
Fig. 1A Prior Art
FIG. 1A is a cross-sectional schematic representation of a typical electrowinning electrolytic cell.
Figure 1B:
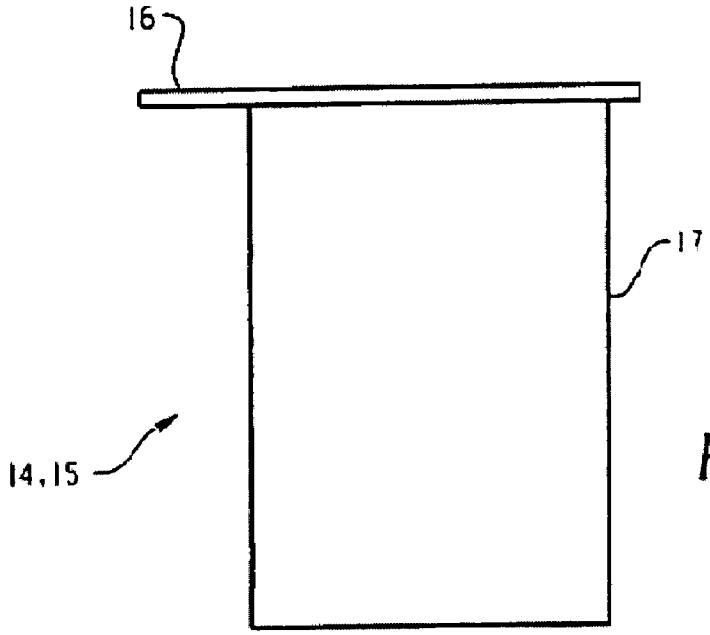
Fig. 1B Prior Art
FIG. 1B is a schematic representation of a typical electrowinning electrolytic plate (both cathode and anode)
Figure 1C:
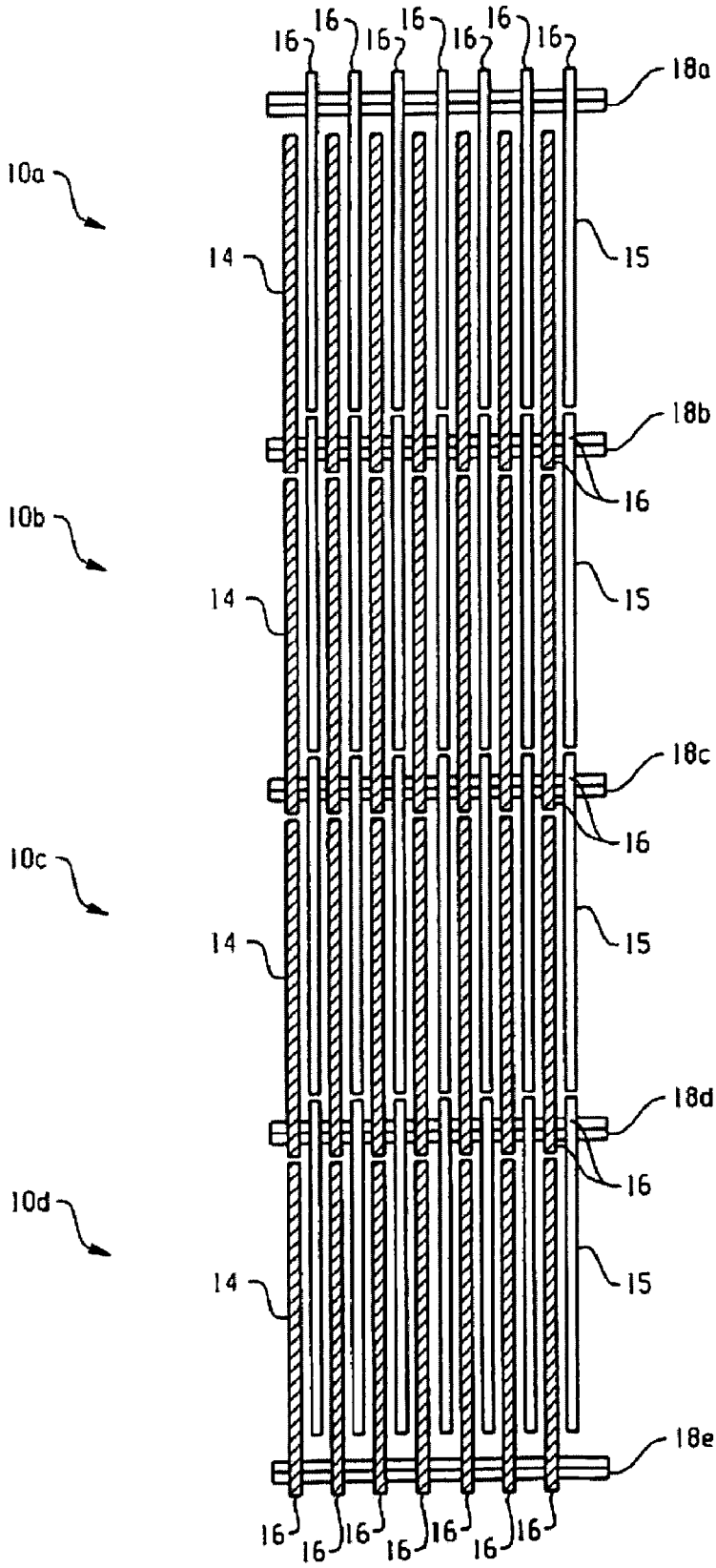
Fig. 1C Prior Art
FIG. 1C is a top schematic representation of a hypothetical typical four-cell electrowinning cell-line.
Figure 2:
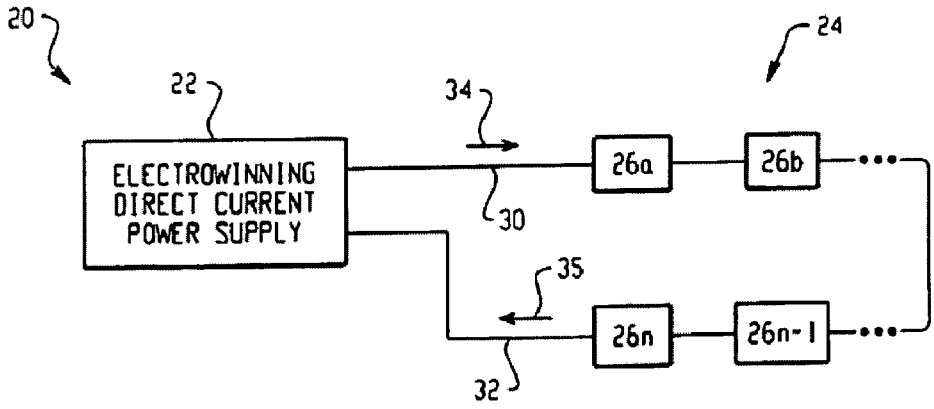
Fig. 2 Prior Art
FIG. 2 is a high-level schematic block diagram of a typical electrowinning system.

According to a third embodiment of the present invention, physical lifting mechanisms are used to automatically lift cathodes and/or anodes to physically break the flow of current through the bank of electrolytic cells if one or more predetermined conditions are met, thus preventing a reverse current from generating and thereby protecting the anodes having electrocatalytically active coatings. Since the anodes 15 and cathodes 14 hang from bus rails 18 (FIG. 1C), they can be easily lifted, e.g., for harvesting the electrodeposited metal or to replace anodes. According to the third embodiment, one or more automated lifting mechanisms are installed to raise all of the anodes or cathodes in one cell 26 (per parallel cell-line), which will break the electrical circuit and prevent a reverse current from generating. Preferably, the lifting mechanism automatically, mechanically lifts (or otherwise moves) at least one end (preferably the end having conductor bar) of all the anodes (or all the cathodes) in a cell. More preferably, the lifting mechanism automatically, mechanically lifts (or otherwise moves) at least one end of all the anodes (or all the cathodes) in a cell simultaneously. In the alternative, the lifting mechanism can be used to move the bus bar 18 away from the conductor bars 16. In a way, the third embodiment is a variation of the first embodiment, with the automated lifting mechanism(s) acting as switch 42. Accordingly, the various trigger and control mechanisms discussed above in connection with FIGS. 3–5 would also apply to the third embodiment. For example, the lifting mechanism can be triggered by a power outage of power source 46 either directly or via the control unit 62. As another example, the control unit controlling the various lifting mechanisms can activate one or more lifting mechanism(s) in response to parameters of the output 30 falling to below the various thresholds (e.g., threshold voltages and threshold currents) discussed above. It is contemplated that virtually any lifting mechanism could be used to lift at least one end of all the anodes (or of the all the cathodes) to implement the third embodiment, e.g., springs, solenoids, motors, cams, hydraulic jacks, screw jacks, other "jacks", pneumatic pistons, rocker arm (i.e. a seesaw mechanism), inflatable balloon/bag (using, e.g., an air cylinder to inflate), etc., configured and placed in circuit communication to break the current path in response to the control unit detecting the various threshold events and/or on its own in response to detecting the various threshold events, e.g., a power failure, etc. Thus, the lifting mechanism is preferably configured and placed in circuit communication so that if all electrical power is lost, the lifting mechanism will trigger and lift one end of all the anodes in a cell to break the current path. For example, if one or more springs are used to lift one end of all the anodes (or cathodes) in a cell, a solenoid or other electromechanical device (e.g., in circuit communication with and powered by the power source 46 and/or controlled by the control unit 62) would be placed in operative engagement with the anodes (or cathodes or the bus bar) to push or pull against the one or more springs to place the conductor bars 16 in engagement with their respective bus bar(s) 18, and when triggered in response to one of the threshold events, the solenoid or other electromechanical device would allow the spring to push or pull the conductor bars 16 and the bus bar 18 away from each other to break the current path.

Figure 9A:
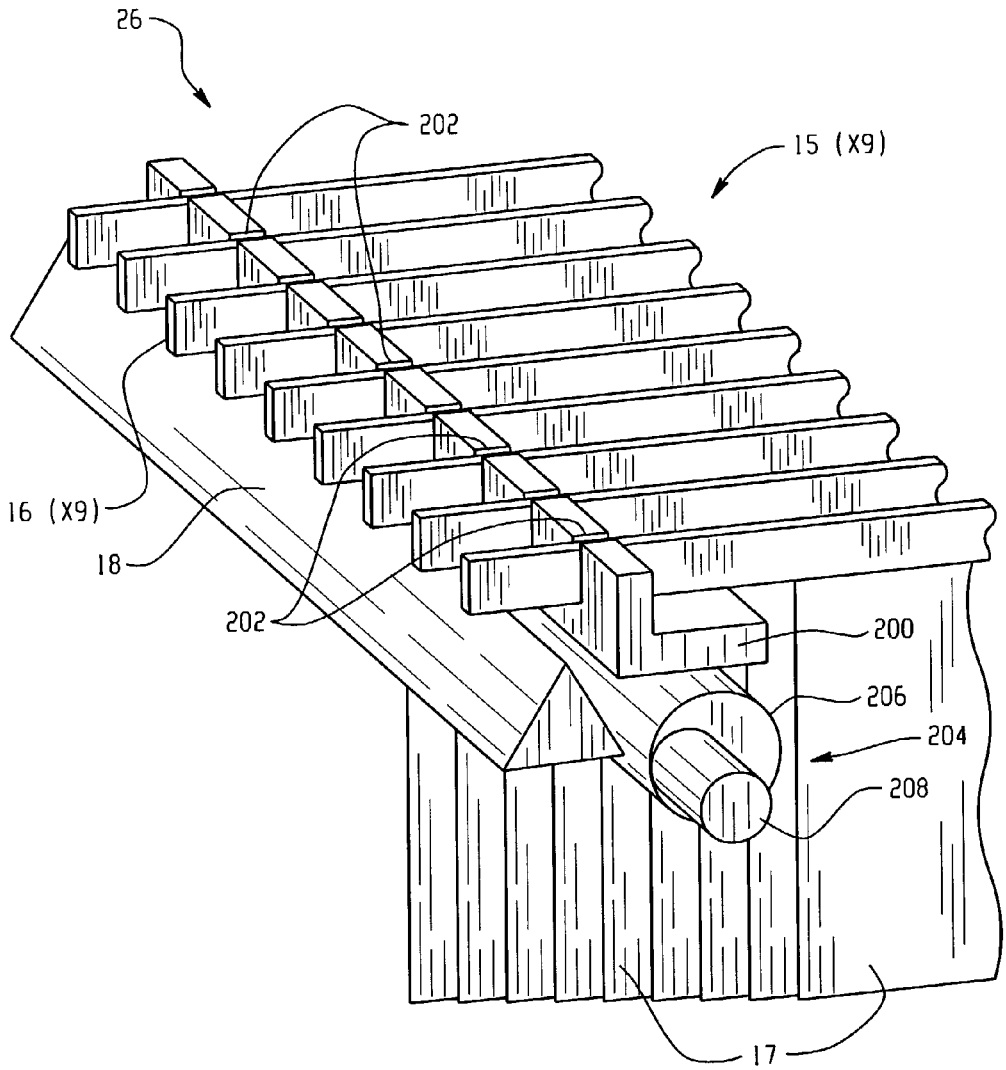
FIGS. 9A and 9B show a variation of the third embodiment in which a cam mechanism is used to physically lift at least one end of the anodes or cathodes off of their respective bus bar to break the circuit and prevent reverse currents from generating.
Figure 9B:
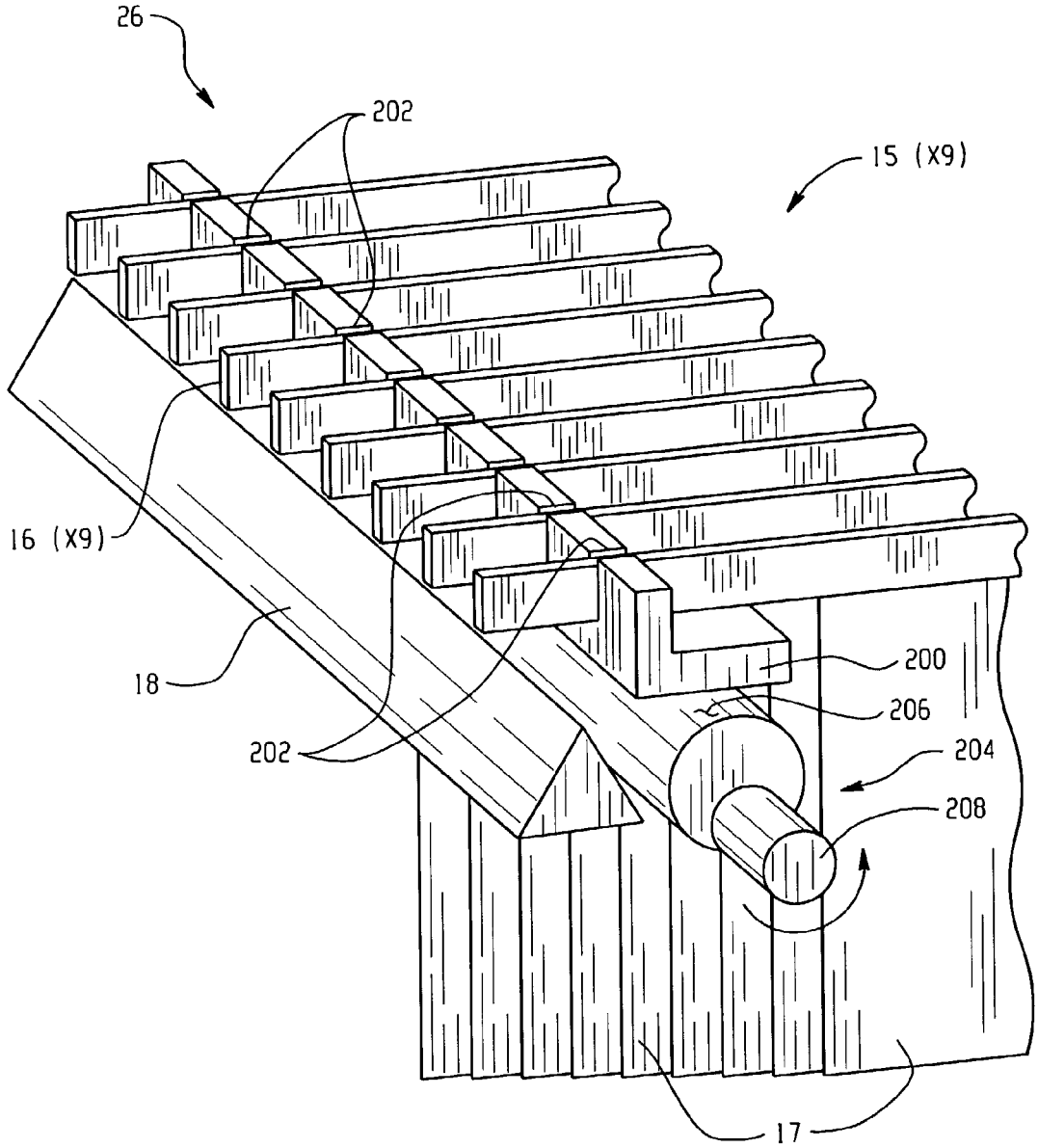

FIGS. 9A and 9B show a mechanism to lift the end (having a conductor bar 16) of all the anodes 15 in a cell 26 off of the bus bar 18. FIGS. 9A and 9B show nine anodes 15 having an associated insulating cradle 200 having one slot 202 per anode 15. The cathodes 14 have been omitted for clarity. The slots 202 in the insulating cradle accept the conducting bar 16 of all nine anodes 15. In FIG. 9A, the nine conducting bars 16 of the nine anodes 15 are in physical contact with and thus directly electrically connected to the bus bar 18; in FIG. 9A, the current 34, 35 can flow through the cell 26. In FIG. 9B, the nine conducting bars 16 of the nine anodes 15 have been lifted off of and thus not directly electrically connected to the bus bar 18; in FIG. 9B the path for the current 34, 35 has been broken. The lifting mechanism in FIGS. 9A and 9B comprises a cam-type lifter 204 having a cam surface 206 that engages the cradle 200 to move the cradle upwards far enough that the nine conductor bars 16 lift off of the bus bar 18. In FIG. 9A, the cam surface 206 is at about the 3 o'clock position and in FIG. 9B the cam surface 206 is in about the 12 o'clock position. It should be apparent to those skilled in the art that these exact positions need not be used; other cam positions and cam configurations can meet the objective of the third embodiment of lifting all the conducting bars 16 off of the bus bar 18. When activated by any of the triggering events discussed above, e.g., by a power outage or by the current 34, 35 or the voltage at output 30 falling to a predetermined threshold, the cam surface is rotated about its axis 208 to lift the anodes and break the connection with the bus bar 18. Consistent with the above discussions, the cam device 204 can be, for example, spring loaded with a compressed spring into the position of FIG. 9B, for example, with an electromechanical device (e.g., a motor or solenoid, etc., not shown) providing a force that tends to rotate the cam device 204 into its FIG. 9A position to allow the conductor bars 16 to physically touch and come into direct electrical connection with their respective bus bar(s) 18. In the alternative, an auxiliary power source can be used to power the control unit and an electromechanical device moving the cam device 204 and to provide sufficient power for the electromechanical device to actuate the cam from its FIG. 9A position to its FIG. 9B position. The electromechanical device would be, for example, powered by the power source 46; thus, if there is a loss of power, the electromechanical device will deactivate, allowing the compressed spring to provide a force that rotates the cam device 204 from its normal position in which the current 34, 35 flows (FIG. 9A position) to a position in which the flow of current 34, 35 has been broken (FIG. 9B) so that no reverse current can generate. In addition thereto, or in the alternative, the electromechanical device could be controlled by the control unit 62 and powered by an auxiliary power source, such as those described herein. In this case, if there is a loss of power, the control unit will control the electromechanical device to provide a force that rotates the cam device 204 from its normal position in which the current 34, 35 flows (FIG. 9A position) to a position in which the flow of current 34, 35 has been broken (FIG. 9B) so that no reverse current can generate. In the alternative or in addition thereto, the spring retractor (i.e., the electromechanical device) could be powered by tapping the EW DC bus.

Figure 10A:
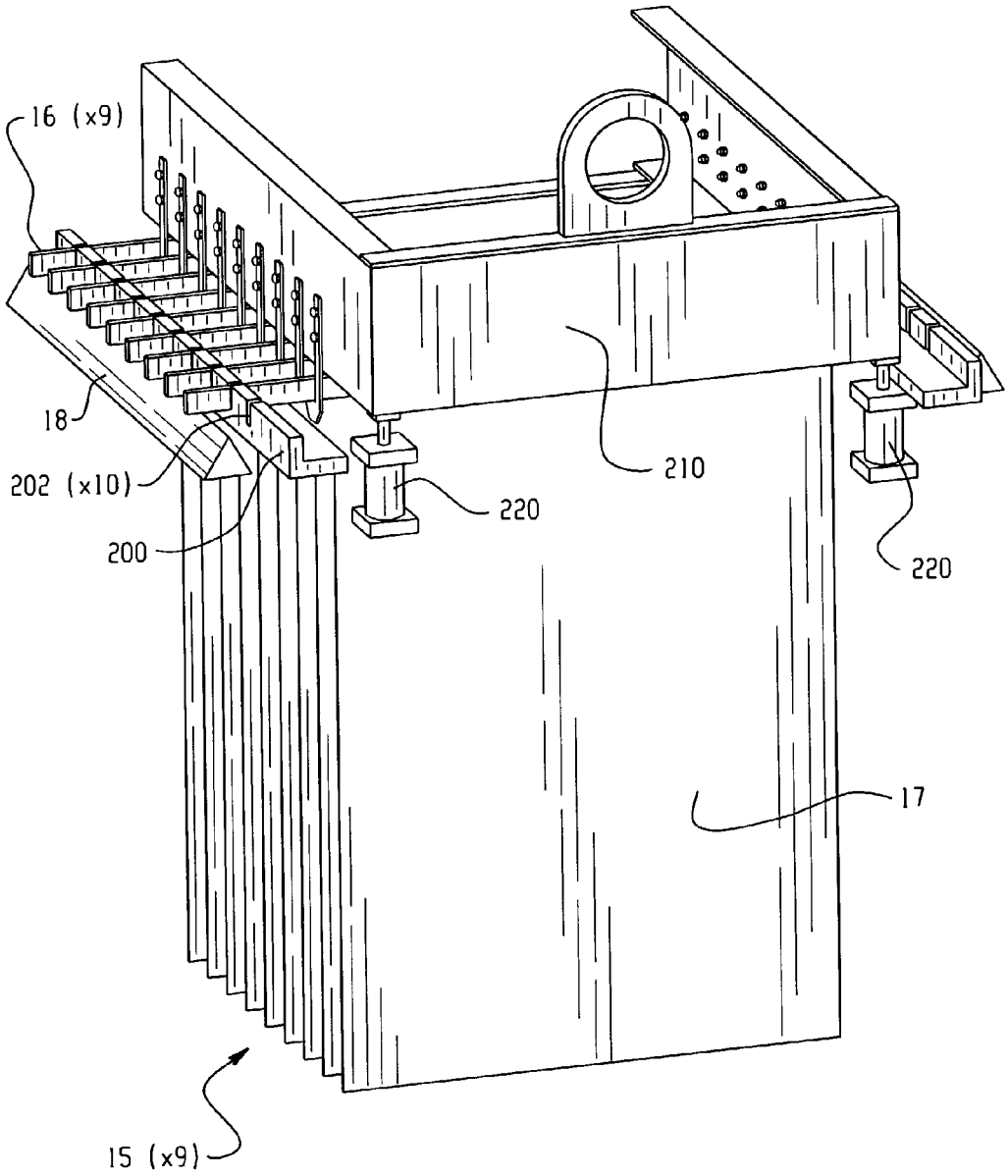
FIGS. 10A and 10B show a variation of the third embodiment in which one or more pneumatic cylinders or air cylinders are used to physically lift at least one end of the anodes or cathodes off of their respective bus bar to break the circuit and prevent reverse currents from generating.
Figure 10B:
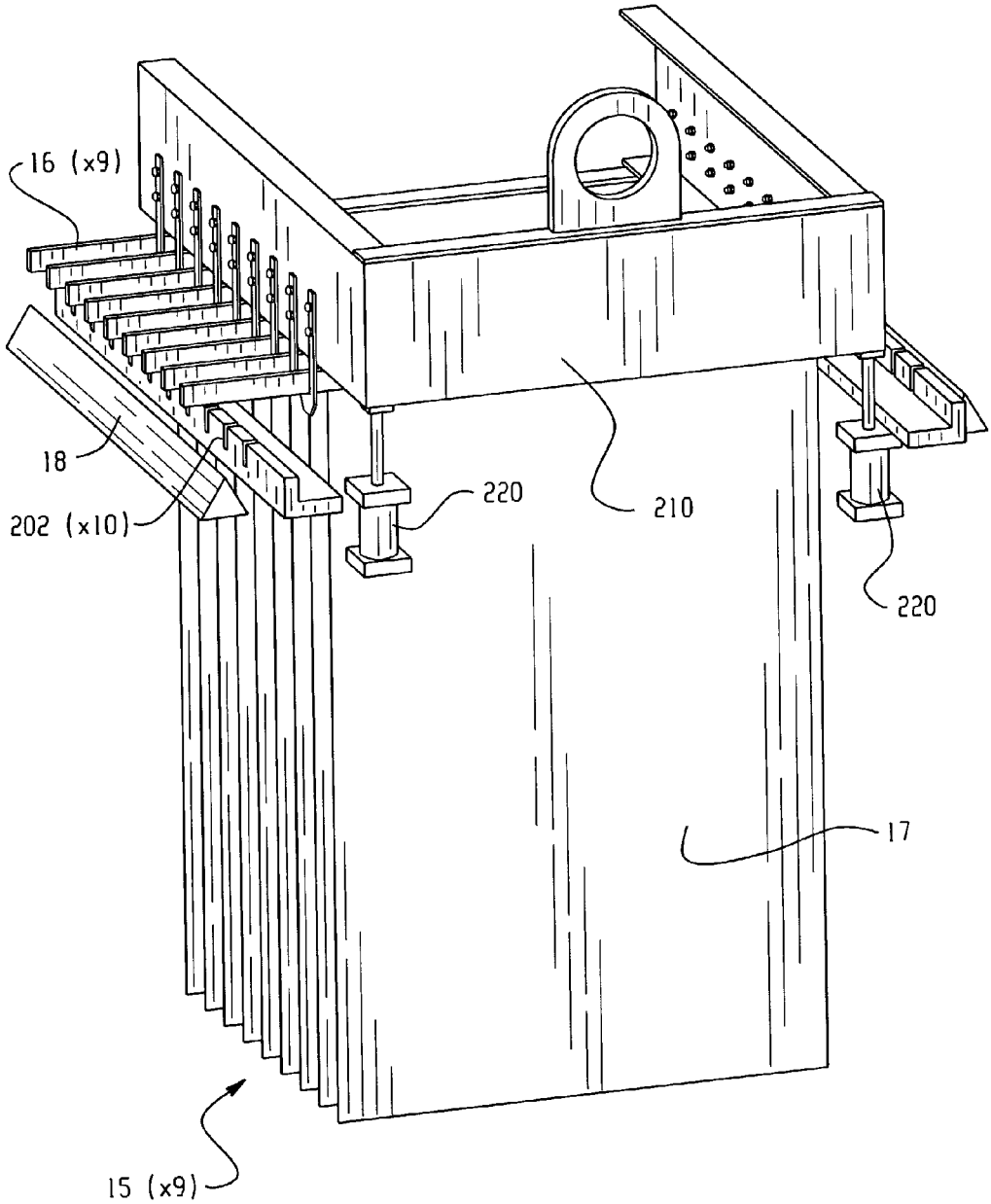

The assembly of FIGS. 9A and 9B can be installed in one or more cells in the cell line to provide redundancy and to provide the ability to perform maintenance on one such assembly while another such assembly provides protection for the sensitive anodes. Also, the assembly of FIGS. 9A and 9B can be made transportable from a first cell to one or more other cells to allow maintenance on the original cell but maintain protection for the circuit with the one or more other cells. In the alternative, compressed air can be used to power the lifting action when a power outage is detected or when any of the other threshold events are detected. FIGS. 10A and 10B show such an air-powered mechanism to lift the conductor bars 16 of all the anodes 15 in a cell 26 off of the bus bar 18. FIGS. 10A and 10B are very similar to FIGS. 9A and 9B, having an insulating cradle 200 having a plurality of slots 202 (at least one for each anode 15) that guide the conductor bars 16 of the anodes 15. However, a typical cathode lifting frame 210, known to those in the art, has been attached to all the anodes (or all the cathodes, not shown) and the cam device 204 of FIGS. 9A and 9B has been replaced with four compressed air cylinders 210 (two not shown in FIGS. 10A and 10B) positioned beneath the lifting frame and in operative engagement with the frame 210 to lift the frame when a threshold event is detected from a conducting position in which the conductor bars are in physical contact with and in direct electrical contact with the bus bar 18 (FIG. 10A) to a raised position in which the conductor bars 16 are raised off of the bus bar 18 so that the current 34, 35 cannot flow and, hence, no reverse current can flow (FIG. 10B). In the alternative, the compressed air cylinders can be placed in such operative engagement with the cradle 200 as discussed above in connection with FIGS. 9A and 9B. The majority of the discussion above with respect to FIGS. 9A and 9B also applies to the variation shown in FIGS. 10A and 10B.

Figure 11:
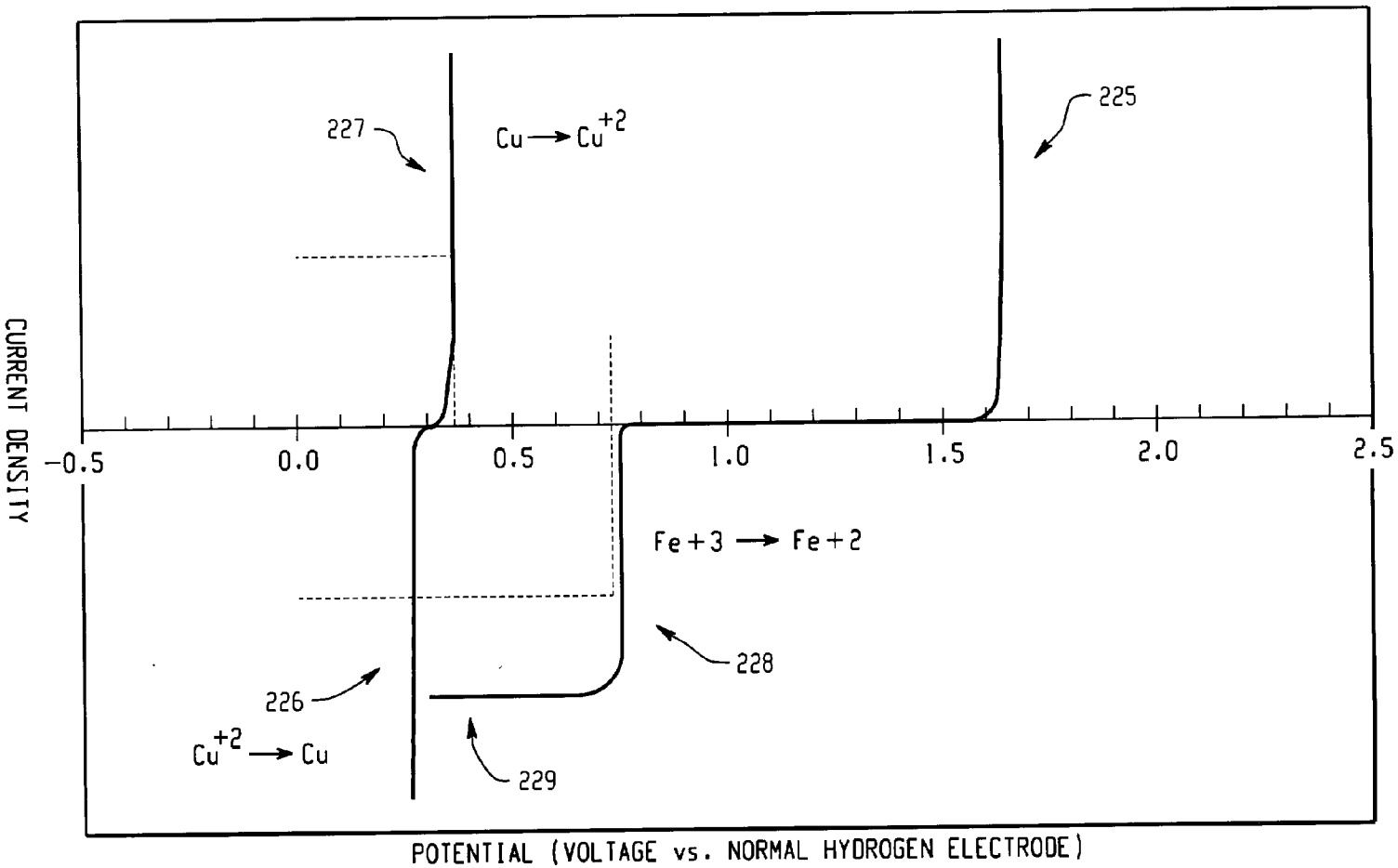
FIG. 11 is a schematic representation of the current-potential relationships in a copper electorwinning cell.

While the above embodiments have described methods for preventing reverse currents in an electrowinning cell by various electrical and mechanical means, it is also possible to provide a method of maintaining polarization positive of the cathodes in an electrowinning cell by chemical means. Referring to FIG. 11, then, there is shown a schematic representation of the current potential relationships in a copper electrowinning cell. It should be noted that the curves in the FIG. 11 are for representational purposes only and not meant to be precise descriptions of the current/potential curves for the indicated reactions.

During normal operation of the cell, the anode will follow the "oxygen at MOL curve" 225, while the cathode follows the $Cu^{2+} \rightarrow Cu^{0}$ curve 226. However, when a reverse current is applied to the cell, the cathode will follow the $Cu^{0} \rightarrow Cu^{2+}$ curve 227, and the anode will move to the $Cu^{2+} \rightarrow Cu^{0}$ curve 226. This change in potential of the anode to the potential where copper is deposited at the $Cu^{2+} \rightarrow Cu^{0}$ curve 226 (ca. less than 0.1 volts vs. NHE, i.e., normal hydrogen electrode), results in the preferential loss of the palladium component in a coating consisting of ruthenium and palladium, as well as possibly some reduction of the ruthenium oxide component of the coating also.

It has been found that, in order to maintain the MOL anode in the potential region where the coating is more stable, i.e. that the anode be maintained positive of the $Cu^{2+} \rightarrow Cu^{0}$ reaction, a soluble species that is more reducible than cupric ($Cu^{2+}$) ions may be added to the electrolyte in an electrowinning cell. Such soluble species is referred to as a "redox couple" or an electrochemically reducible species and a corresponding oxidizable product. Where such a redox couple is added to the electrochemical cell, in a reverse current situation, the MOL anode will then follow the current-potential curve for that particular redox couple.

In an electrowinning cell, there are, generally, redox couples present depending on the impurities. Typically, in addition to $Cu^{2+}/Cu$ and $H_2O/O_2$, there can be present $Mn^{2+}/MnO_2$ and $Fe^{2+}/Fe^{3+}$. Generally, there is a significant amount of the ferrous/ferric ($Fe^{2+}/Fe^{3+}$) redox couple in an electrowinning cell, i.e., on the order of from about 1 gram per liter (gpl) to about 7–8 gpl, with the ferrous:ferric ratio being from about 1:2.5 to about 1:7. In the present invention, then, an additional amount of the ferric ($Fe^{3+}$) ion may be added to the electrolyte in order to prevent damage to the MOL coating in a reverse current situation. Additional redox couples which could be utilized include $Co^{+2}/Co^{+3}$, $Ce^{+3}/Ce^{+4}$, $VO_2^{+2}VO^{+2}$, $NO_3^{-}/NO_2^{-}$.

Referring again to FIG. 11, there is illustrated a ferrous/ferric ($Fe^{2+}/Fe^{3+}$) redox couple and its current potential curve 228. As the ferric ion ($Fe^{3+}$) is more easily reducible than cupric ions, the anode will follow the current potential curve 228 for ($Fe^{2+}/Fe^{3+}$) during a flow of reverse current. As long as the magnitude of the reverse current is below the limiting current 229 for the ferric reduction reaction, the anode will stay on the ($Fe^{2+}/Fe^{3+}$) current potential curve 228. The limiting current 229 is a function of the concentration of ferric ions and mass transport (e.g. flow) to the electrode surface.

The addition of the ferric ion may be maintained at a constant level in the electrolyte during normal electrowinning operation. It is also contemplated that the ferric ion may be added during prolonged power outages. The amount of ferric ion in the form of a soluble ferric compound (e.g. ferric sulfate, ferric chloride, etc.) can be maintained at a level of from about 5 gpl up to about 50 gpl. During prolonged power outages, ferric ion may be added to the electrolyte at a rate of from 1 gram per hour per square meter of anode area to 2000 gram per hour per square meter. In the alternative to maintaining the ferric ion at a constant level in the electrolyte during normal electrowinning operation, the ferric ion can be added to the EW cells responsive to meeting a predetermined condition. For example, the ferric ion can be placed in a container (not shown) such that the ferric ion is automatically added to the electrolyte upon loss of DC power. This addition of ferric ion could be triggered by a control unit signal responsive to one or more of the conditions used to trigger embodiments 1–3, e.g., the EW DC supply voltage reaches a predetermined threshold and/or the EW DC supply current reaches a predetermined threshold. This addition could be made at the main cell feed (not shown), assuming the circulating pumps are not affected by the DC power outage, or could be by means of a container attached to (e.g., in selective fluid connection with) each individual electrowinning cell in a manner that each container is opened (e.g., placed in fluid communication with a respective EW cell) upon loss of DC power.

Various methods for the installation of anodes and maintenance of the electrowinning cells can also be utilized for the protection of platinum group metal-oxide containing coatings on anodes in electrowinning cells. "Replacement anodes" may be installed in an electrowinning cell which contains a plurality of existing anodes of lead sheets. The term "replacement anodes" is used herein to describe MOL™ anodes and coated valve metal anodes. By coated valve metal anodes it is meant an electrode base of a valve metal having an electrocatalytically active coating thereon. The base of a valve metal can be such metal including titanium, tantalum, zirconium, niobium, and tungsten. Of particular interest for its ruggedness, corrosion resistance and availability is titanium. As well as the normally available elemental metals themselves, the suitable metals of the electrode base can include metal alloys and intermetallic mixtures, as well as ceramics and cermets such as contain one or more valve metals. The electrode base may take various forms, including mesh, sheet, blades, tubes or wire form.

In a method for installing replacement anodes in an electrowinning cell which contains existing anodes of lead sheets, it is first necessary to clean the cell from lead sludge which may have built up due to the corrosion and erosion of the existing lead sheet anodes. Ordinary electrowinning cell maintenance is known in the art and will only be described briefly herein. It is preferred to first place the jumper frame over the cell nearest to the anode bus system (e.g. nearest the rectifier or "turn-a-round" point of the cell line) such that the frame contacts the cell directly or contacts cells on both sides of said cell. This cell placement allows for the least inconvenience to operators when maintaining the remaining cells containing lead sheet anodes. The jumper frame allows current to bypass the cell that is being worked on, effectively removing the cell from the electrical circuit. Following removal of the lead sheet anodes, cathodes and electrolyte, maintenance on the cell is performed, including being cleaned of any lead sludge build-up. The lead sheet anodes, cathodes and electrolyte are then replaced, the jumper frame removed allowing current to be applied to the cell in an amount equal to or greater than 500 amperes (nominally 1–2 $A/m^2$ of anode area). This amperage is critical because it insures that the lead sheet anodes are adequately polarized to evolve oxygen gas and are not generating a reverse current.

Where the lead sheet anodes in an electrowinning cell are to be substituted, and following cleaning of the cell of any lead sludge build-up, a portion of the lead sheet anodes are removed at one time in an amount from one single anode to about ⅓ of the total anodes in the cell. The lead sheet anodes are then substituted with an equal number of replacement anodes. The replacement of lead sheet anodes continues until the entire cell contains only replacement anodes. By starting the exchange of existing lead sheet anodes for replacement anodes in a cell contacted directly to the anode bus system, the method allows the remaining cells containing lead anode sheets to be jumpered out for maintenance and avoids placing a replacement anode under the jumper frame, thereby causing a reverse current through the replacement anodes.

Figure 12:
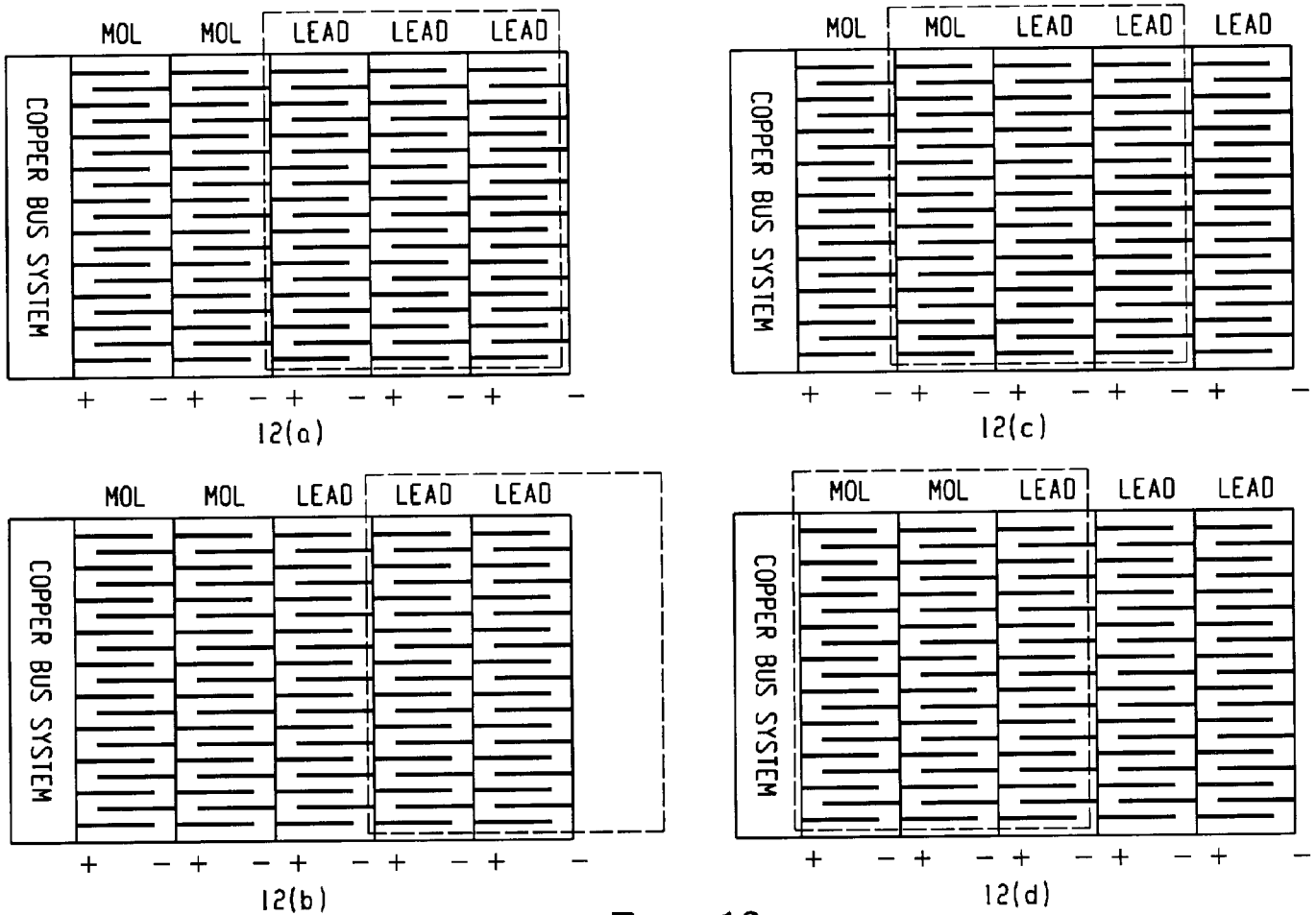
FIG. 12 is a schematic representation of acceptable and unacceptable jumper frame placement for avoiding reverse current through electrolytic cells.

While a benefit of the MOL technology is that electrowinning cells should not require cleaning for prolonged periods of time, as described in U.S. Pat. No. 6,139,705, maintenance may be eventually required or desired. The electrowinning cell containing replacement anodes in the circuit containing lead sheet anodes may be maintained following a similar method for the installation of replacement anodes but in a reverse operation. Of importance for cell maintenance is the placement of the jumper frame. With reference to FIG. 12, there is shown acceptable (12*a*, 12*b*) and unacceptable (12*c*, 12*d*) jumper frame placement. In order to avoid reverse currents, replacement anodes should be substituted with standard lead sheet anodes in cells which are undergoing maintenance while the circuit has a current applied thereto. Where the cell containing replacement anodes is closest to the anode bus system (e.g. nearest the rectifier), anodes in the adjacent cell containing replacement anodes must also be replaced with standard lead anodes so as to avoid reverse currents. Following substitution of the replacement anodes with standard lead anodes, normal cell maintenance may be carried out, which cell maintenance has been described hereinabove and is known to those in the art. Subsequent to completion of cell maintenance, the jumper frame can be removed and the standard lead anodes substituted with replacement anodes with the circuit having a current applied thereto, as in the foregoing installation process. It is important, however, that the jumper frame is never placed over a cell containing replacement anodes and a cell containing lead sheet anodes in an electrowinning circuit with mixed anode types.

The various embodiments and variations taught herein can be combined in virtually any combination or permutation to provide redundant protection for the sensitive anodes. For example, the relatively simple variation of the first embodiment in which the switch 42 is powered by the EW voltage at output 30 into the closed position (so that when the EW DC signal at output 30 fails, the switch 42 opens, preventing a reverse current from generating) can be combined with any of the variations of the second embodiment.

As has been discussed hereinbefore, and while particular reference has been made to copper electrowinning in certain embodiments, the systems and methods presented herein may be utilized in electrowinning cells containing a metal other than copper. Such cells can include electrowinning of zinc, cadmium, chromium, nickel, cobalt, manganese, silver, lead, gold, platinum, palladium, tin, aluminum, and iron. When utilizing the systems and methods of the invention in an electrowinning cell beyond a consideration of copper electrowinning, in which there is utilized a sulfate electrolyte, the electrolyte might include substituents such as magnesium sulfate and potassium sulfate, or zinc sulfate and sodium sulfate, such as in zinc electrowinning. It is also contemplated that the electrolyte may be a chloride electrolyte and contain a metal chloride salt plus have a hydrochloric acid component.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the bus bars 18 can be fabricated with a conducting portion and an insulating portion, e.g., a cylindrical composite structure having a first longitudinal portion made of copper to make direct electrical conduct with the conductor bars of all the anodes (or all the cathodes) of a cell and a second longitudinal portion made of an insulating material. In this example, for normal use, the conducting portion would face upward and the conductor bars 16 would rest on the copper portion, and when triggered by one of the threshold events described herein, the cylinder would be moved, e.g., rotated (e.g., either by spring force or by one of the electromechanical devices listed above), so that the conductor bars 16 rest on the insulating portion, thereby breaking the flow of current 34, 35 through the cells 26. Therefore, the invention in its broader aspects is not limited to the specific details, representative apparatus and methods, and illustrative examples shown and described. Accordingly, departures may be made from such details without departing from the spirit or scope of the applicant's general inventive concept.

What is claimed is:

1. An electrowinning system, comprising:

(a) at least one electrowinning cell including a plurality of electrowinning anodes, a plurality of electrowinning cathodes, and electrolyte, at least one of said electrowinning anodes having thereon at least one electrocatalytically active coating susceptible to damage caused by reverse currents;

(b) an electrowinning direct current power supply in circuit communication with said at least one electrowinning cell and providing an electrical output to said at least one electrowinning cell to cause said electrowinning cell to electrodeposit material;

(c) a control unit in circuit communication with said electrowinning direct current power supply and monitoring at least one parameter of said electrowinning direct current power supply, said control unit automatically asserting an auxiliary power control signal responsive to the at least one parameter of said electrowinning direct current power supply meeting a predetermined criterion; and (d) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

2. An electrowinning system according to claim 1 wherein said control unit monitors at least a voltage of said electrowinning direct current power supply, and further wherein said control unit automatically asserts an auxiliary power control signal responsive to the voltage of said electrowinning direct current power supply meeting a predetermined threshold.

3. An electrowinning system according to claim 2 wherein said control unit automatically asserts the auxiliary power control signal responsive to the voltage of said electrowinning direct current power supply falling below about 1.4 volts per series-connected electrolytic cell in said at least one electrowinning cell.

4. An electrowinning system according to claim 1 wherein said control unit monitors at least a current of said electrowinning direct current power supply, and further wherein said control unit automatically asserts an auxiliary power control signal responsive to the current of said electrowinning direct current power supply meeting a predetermined threshold.

5. An electrowinning system according to claim 4 wherein said control unit automatically asserts the auxiliary power control signal responsive to the current of said electrowinning direct current power supply falling to about zero amperes.

6. An electrowinning system according to claim 4 wherein said control unit automatically asserts the auxiliary power control signal responsive to the current of said electrowinning direct current power supply falling to below zero amperes.

7. An electrowinning system according to claim 4 wherein said control unit automatically asserts the auxiliary power control signal responsive to the current of said electrowinning direct current power supply falling to below one ampere per square meter of area of the at least one electrowinning anode having thereon at least one electrocatalytically active coating susceptible to damage caused by reverse currents.

8. An electrowinning system according to claim 4 wherein said control unit automatically asserts the auxiliary power control signal responsive to the current of said electrowinning direct current power supply falling to below two amperes per square meter of area of the at least one electrowinning anode having thereon at least one electrocatalytically active coating susceptible to damage caused by reverse currents.

9. An electrowinning system, comprising:

(a) at least one electrowinning cell including a plurality of electrowinning anodes, a plurality of electrowinning cathodes, and electrolyte, at least one of said electrowinning anodes having thereon at least one electrocatalytically active coating susceptible to damage caused by reverse currents;

(b) an electrowinning direct current power supply in circuit communication with said at least one electrowinning cell and providing an electrical output to said at least one electrowinning cell to cause said electrowinning cell to electrodeposit material; and (c) means for automatically maintaining the polarization of said at least one anode having thereon at least one electrocatalytically active coating susceptible to damage caused by reverse currents positive with respect to at least one corresponding cathode, regardless of whether or not said electrowinning direct current power supply is providing an electrical output sufficient to maintain polarization of said at least one anode positive with respect to said at least one corresponding cathode.

10. An electrowinning system according to claim 9 wherein said means for automatically maintaining the polarization of said at least one anode comprises:

(a) a control unit in circuit communication with said electrowinning direct current power supply and monitoring at least one parameter of said electrowinning direct current power supply, said control unit automatically asserting an auxiliary power control signal responsive to the at least one parameter of said electrowinning direct current power supply meeting a predetermined criterion; and (b) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

11. An electrowinning system according to claim 9 wherein said means for automatically maintaining the polarization of said at least one anode comprises:

(a) a control unit in circuit communication with said electrowinning direct current power supply and monitoring at least a voltage of said electrowinning direct current power supply, said control unit automatically asserting an auxiliary power control signal responsive to the voltage of said electrowinning direct current power supply meeting a predetermined threshold; and (b) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

12. An electrowinning system according to claim 11 wherein said control unit automatically asserts the auxiliary power control signal responsive to the voltage of said electrowinning direct current power supply falling below about 1.4 volts per series-connected electrolytic cell in said at least one electrowinning cell.

13. An electrowinning system according to claim 9 wherein said means for automatically maintaining the polarization of said at least one anode comprises:

(a) a control unit in circuit communication with said electrowinning direct current power supply and monitoring at least a current of said electrowinning direct current power supply, said control unit automatically asserting an auxiliary power control signal responsive to the current of said electrowinning direct current power supply meeting a predetermined threshold; and (b) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

14. An electrowinning system according to claim 13 wherein said control unit automatically asserts the auxiliary power control signal responsive to the current of said electrowinning direct current power supply falling to about zero amperes.

15. An electrowinning system according to claim 13 wherein said control unit automatically asserts the auxiliary power control signal responsive to the current of said electrowinning direct current power supply falling to below zero amperes.

16. An electrowinning system according to claim 13 wherein said control unit automatically asserts the auxiliary power control signal responsive to the current of said electrowinning direct current power supply falling to below one ampere per square meter of area of the at least one electrowinning anode having thereon at least one electrocatalytically active coating susceptible to damage caused by reverse currents.

17. An electrowinning system according to claim 13 wherein said control unit automatically asserts the auxiliary power control signal responsive to the current of said electrowinning direct current power supply falling to below two amperes per square meter of area of the at least one electrowinning anode having thereon at least one electrocatalytically active coating susceptible to damage caused by reverse currents.

18. An electrowinning system, comprising:

(a) at least one electrowinning cell including a plurality of electrowinning anodes, a plurality of electrowinning cathodes, and electrolyte, at least one of said electrowinning anodes having thereon at least one electrocatalytically active coating susceptible to damage caused by reverse currents;

(b) an electrowinning direct current power supply in circuit communication with said at least one electrowinning cell and providing an electrical output to said at least one electrowinning cell to cause said electrowinning cell to electrodeposit material; and (c) means for automatically preventing a reverse current from damaging the electrocatalytically active coating of said at least one anode having thereon at least one electrocatalytically active coating susceptible to damage caused by reverse currents, regardless of whether or not said electrowinning direct current power supply is providing an electrical output sufficient to prevent a reverse current from damaging the electrocatalytically active coating of said at least one anode.

19. An electrowinning system according to claim 18 wherein said means for automatically preventing a reverse current from damaging the electrocatalytically active coating of said at least one anode comprises:

(a) a control unit in circuit communication with said electrowinning direct current power supply and monitoring at least one parameter of said electrowinning direct current power supply, said control unit automatically asserting an auxiliary power control signal responsive to the at least one parameter of said electrowinning direct current power supply meeting a predetermined criterion; and (b) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

20. An electrowinning system according to claim 19 wherein:

(a) said at least one auxiliary power supply comprises at least a first auxiliary power supply and a second auxiliary power supply;

(b) said first auxiliary power supply selectively providing a first auxiliary electrical output to said at least one electrowinning cell responsive to the auxiliary power control signal from said control unit, the first auxiliary electrical output being sufficient to maintain polarization of said at least one anode positive with respect to said at least one corresponding cathode;

(c) said first auxiliary power supply having more limited availability than said second auxiliary power supply;

(d) said second auxiliary power supply selectively providing a second auxiliary electrical output to said at least one electrowinning cell responsive to the auxiliary power control signal from said control unit, the second auxiliary electrical output being sufficient to maintain polarization of said at least one anode positive with respect to said at least one corresponding cathode; and (e) said first and second auxiliary power supplies are prioritized so that said first auxiliary power supply is used to provide the first auxiliary electrical output to said at least one electrowinning cell only if said second auxiliary power supply is unavailable to provide the second auxiliary electrical output to said at least one electrowinning cell.

21. An electrowinning system according to claim 20 wherein said first auxiliary power supply comprises a battery bank and said second auxiliary power supply comprises a motor-driven generator in circuit communication with a DC rectifier.

22. An electrowinning system according to claim 20 wherein said control unit prioritizes said first and second auxiliary power supplies so that said first auxiliary power supply is used to provide the first auxiliary electrical output to said at least one electrowinning cell only if said second auxiliary power supply is unavailable to provide the second auxiliary electrical output to said at least one electrowinning cell.

23. An electrowinning system according to claim 18 wherein said means for automatically preventing a reverse current from damaging the electrocatalytically active coating of said at least one anode comprises:

(a) a control unit in circuit communication with said electrowinning direct current power supply and monitoring at least a voltage of said electrowinning direct current power supply, said control unit automatically asserting an auxiliary power control signal responsive to the voltage of said electrowinning direct current power supply meeting a predetermined threshold; and (b) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

24. An electrowinning system according to claim 23 wherein said control unit automatically asserts the auxiliary power control signal responsive to the voltage of said electrowinning direct current power supply falling below 1.4 volts per series-connected electrolytic cell in said at least one electrowinning cell.

25. An electrowinning system according to claim 18 wherein said means for automatically preventing a reverse current from damaging the electrocatalytically active coating of said at least one anode comprises:

(a) a control unit in circuit communication with said electrowinning direct current power supply and monitoring at least a current of said electrowinning direct current power supply, said control unit automatically asserting an auxiliary power control signal responsive to the current of said electrowinning direct current power supply meeting a predetermined threshold; and (b) at least one auxiliary power supply selectively providing an auxiliary electrical output to said at least one electrowinning cell responsive to the auxiliary power control signal from said control unit, the auxiliary electrical output being sufficient to maintain polarization of said at least one anode positive with respect to said at least one corresponding cathode.

26. An electrowinning system according to claim 25 wherein said control unit automatically asserts the auxiliary power control signal responsive to the current of said electrowinning direct current power supply falling to about zero amperes.

27. An electrowinning system according to claim 25 wherein said control unit automatically asserts the auxiliary power control signal responsive to the current of said electrowinning direct current power supply falling to below zero amperes.

28. An electrowinning system according to claim 25 wherein said control unit automatically asserts the auxiliary power control signal responsive to the current of said electrowinning direct current power supply falling to below one ampere per square meter of area of the at least one electrowinning anode having thereon at least one electrocatalytically active coating susceptible to damage caused by reverse currents.

29. An electrowinning system according to claim 25 wherein said control unit automatically asserts the auxiliary power control signal responsive to the current of said electrowinning direct current power supply falling to below two amperes per square meter of area of the at least one electrowinning anode having thereon at least one electrocatalytically active coating susceptible to damage caused by reverse currents.

* * * * *